US007120970B2

(12) United States Patent
Thomson et al.

(10) Patent No.: US 7,120,970 B2
(45) Date of Patent: Oct. 17, 2006

(54) DEVICES FOR HOLDING PAPER, CARDS, AND WALLETS

(75) Inventors: Chip E. Thomson, Austin, TX (US); Glen E. Clifton, Austin, TX (US); Michael C. Lah, Round Rock, TX (US); Lauren S. Brenneman, Austin, TX (US); Joseph B. Wieck, Austin, TX (US)

(73) Assignee: beza, L.P., Austin, TX (US)

( * ) Notice: Subject to any disclaimer, the term of this patent is extended or adjusted under 35 U.S.C. 154(b) by 0 days.

(21) Appl. No.: 10/813,640

(22) Filed: Mar. 29, 2004

(65) Prior Publication Data

US 2005/0210633 A1 Sep. 29, 2005

Related U.S. Application Data

(60) Provisional application No. 60/458,492, filed on Mar. 28, 2003.

(51) Int. Cl.
*B42F 1/00* (2006.01)

(52) U.S. Cl. ..... 24/67.5; 24/67 R

(58) Field of Classification Search ..... 24/67.3, 24/67.5, 462, 3.12, 326, 327, 570, 546, 545
See application file for complete search history.

(56) References Cited

U.S. PATENT DOCUMENTS

| | | | | |
|---|---|---|---|---|
| 475,425 | A | 5/1892 | Vawter et al. | |
| 590,094 | A * | 9/1897 | Duncan | 24/456 |
| 1,133,388 | A | 3/1915 | Merrill | |
| 1,139,627 | A | 5/1915 | Baltzley | |
| 1,150,073 | A | 8/1915 | Spengler | |
| 1,435,917 | A | 11/1922 | Ensign | |
| 2,125,768 | A | 8/1938 | Christensen et al. | 40/23 |
| 4,129,237 | A | 12/1978 | Grinder | 224/5 |
| 4,286,358 | A | 9/1981 | Levin | 24/67 R |
| 4,332,060 | A | 6/1982 | Sato | 24/67.9 |
| 4,402,530 | A | 9/1983 | Daguerre | 281/45 |
| 4,532,680 | A | 8/1985 | Hashimoto | 24/67 R |
| D283,844 | S | 5/1986 | Saad et al. | D2/430 |
| 4,675,953 | A | 6/1987 | Higgs | 24/499 |
| 4,735,438 | A * | 4/1988 | Demarest, Jr. | 24/67.3 |
| 4,761,862 | A | 8/1988 | Hiromori | 24/67.9 |
| 4,802,263 | A * | 2/1989 | Lorber | 24/67.5 |
| D321,209 | S | 10/1991 | Hiromori | D19/65 |
| D321,210 | S | 10/1991 | Hiromori | D19/65 |
| 5,080,223 | A | 1/1992 | Mitsuyama | 206/39.5 |
| 5,249,336 | A | 10/1993 | Miller | 24/67.5 |
| 5,249,437 | A | 10/1993 | Cole, Jr. | 63/2 |
| 5,533,236 | A | 7/1996 | Tseng | 24/67.5 |
| D372,498 | S | 8/1996 | Sato | D19/65 |
| 5,653,276 | A | 8/1997 | Niernberger | 150/137 |
| 5,806,147 | A | 9/1998 | Sato | 24/67.9 |

(Continued)

FOREIGN PATENT DOCUMENTS

| | | |
|---|---|---|
| FR | 2714807 | 7/1995 |

*Primary Examiner*—Robert J. Sandy
(74) *Attorney, Agent, or Firm*—Fulbright & Jaworski L.L.P.

(57) ABSTRACT

Devices for holding paper, cards, and/or wallets. One device has a clip with two ends and a leverage bump; and an arm pivotally coupled to each end. One of the arms contacts the leverage bump when the clip is opened. Another device includes a clip having a receiving portion and a holding portion. The receiving portion includes an arch. The holding portion includes two ends. An arm is pivotally coupled to each end. Other devices are included.

29 Claims, 37 Drawing Sheets

U.S. PATENT DOCUMENTS

| | | | | |
|---|---|---|---|---|
| 5,896,624 | A | 4/1999 | Horswell | 24/67.5 |
| 5,950,283 | A | 9/1999 | Sato | 24/67 |
| 6,327,749 | B1 | 12/2001 | Antinone | 24/67 R |
| 6,374,463 | B1 | 4/2002 | Kaufman | 24/67.5 |
| D479,146 | S * | 9/2003 | Manley | D11/78.1 |
| D485,780 | S | 1/2004 | Thomson | D11/78.1 |
| 6,732,419 | B1 * | 5/2004 | Davis | 24/67 R |
| 6,745,805 | B1 | 6/2004 | Thomson | 150/137 |
| 2003/0140996 | A1 | 7/2003 | Thomson | 150/138 |

* cited by examiner

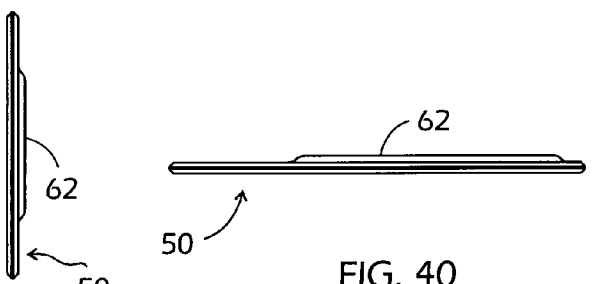
FIG. 39
FIG. 40
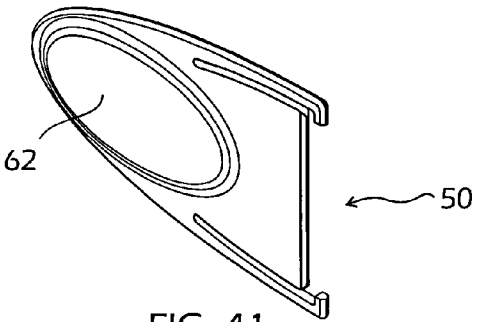
FIG. 41
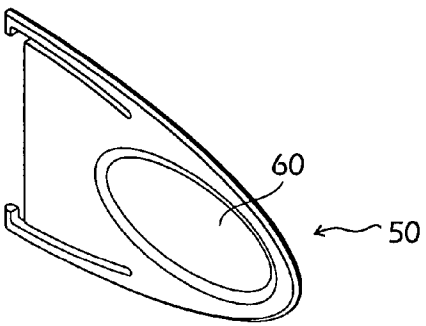
FIG. 42
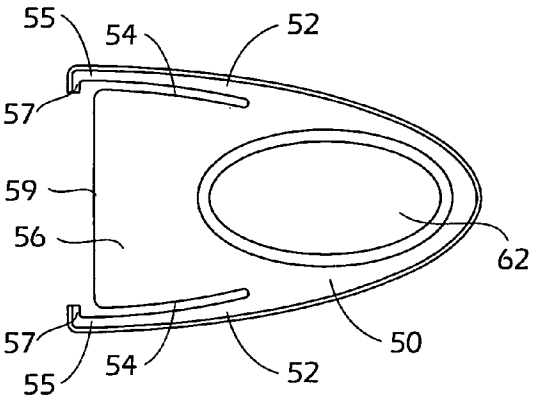
FIG. 37
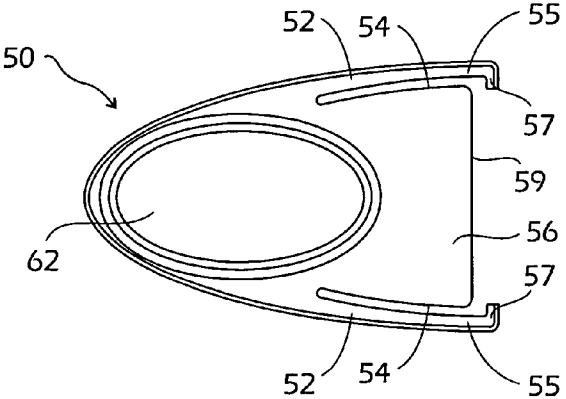
FIG. 38

DEVICES FOR HOLDING PAPER, CARDS, AND WALLETS

CROSS-REFERENCE(S) TO RELATED APPLICATION(S)

This application claims priority to U.S. Provisional Patent Application Ser. No. 60/458,492, filed Mar. 28, 2003, the entire contents of which are expressly incorporated by reference.

BACKGROUND OF THE INVENTION

1. Field of the Invention

The present invention relates generally to devices that hold paper, cards, and/or a wallet.

2. Description of Related Art

Devices that hold money, whether in the form of paper currency or credit cards, come in a variety of shapes and sizes. Examples of such devices, sometimes referred to as money clips, are found in U.S. Pat. Nos. 6,327,749, 5,249,437, and 4,675,953. Devices known as binder clips, which are typically used in an office setting for keeping documents together in the absence of a staple, have been used as money clips. This is true of both binder clips without ornamentation of any kind, such as those depicted in U.S. Pat. Nos. 1,150,073 and 1,139,627, and with ornamentation as shown in U.S. Pat. No. 6,327,749. Other binder clips are disclosed in U.S. Pat. Nos. D372,498 and D321,210.

SUMMARY OF THE INVENTION

The present invention includes devices suited to holding paper (such as currency, notes, receipts, business cards or the like), cards (such as credit cards or the like), and/or wallets. The devices may be used to advertise corporate or other types of logos. The present devices may be referred to as money clips, although they are well-suited to holding things other than money.

In one embodiment, the invention is a device that comprises a clip having two ends and a leverage bump; and an arm pivotally coupled to each end. One of the arms contacts the leverage bump when the clip is opened. In one version of this embodiment, the leverage bump includes two outer portions and a middle portion, and the two outer portions protrude more outwardly from the clip than the middle portion. In another version of this embodiment, the clip has two leverage bumps, and each arm contacts a leverage bump when the clip is opened. In another version of this embodiment, each leverage bump includes two outer portions and a middle portion, and the two outer portions of each leverage bump protrude more outwardly from the clip than the middle portion. In another version of this embodiment, each arm includes two hinge elements separated by two slots and a middle segment, and each hinge element has an elongated segment and a hinge segment. In another version of this embodiment, each end of the clip includes an arm-retaining portion, and the hinge segments of a given arm fit at least partially within the arm-retaining portion of an end of the clip. In another version of this embodiment, the hinge elements of each arm are longer than the middle segment of that arm. In another version of this embodiment, an edge of the middle segment of each arm is positioned near the arm-retaining portion of an end of the clip. In another version of this embodiment, each arm has a widest portion and the clip has a widest portion, and the widest portions of the arms and the clip have substantially the same width. In another version of this embodiment, the widest portion of each arm is positioned near the widest portion of the clip. In another version of this embodiment, each arm includes an indention. In another version of this embodiment, each arm includes an insert in the indention. In another version of this embodiment, the device also includes a wallet configured to be held by the clip.

In another embodiment, the invention is a device that includes a clip having a receiving portion and a holding portion, the receiving portion including an arch, and the holding portion including two ends; and an arm pivotally coupled to each end. In one version of this embodiment, the clip has two leverage bumps, and each arm contacts a leverage bump when the clip is opened. In another version of this embodiment, each arm includes two hinge elements separated by two slots and a middle segment, and each hinge element has an elongated segment and a hinge segment. In another version of this embodiment, each end of the clip includes an arm-retaining portion, and the hinge segments of a given arm fit at least partially within the arm-retaining portion of an end of the clip. In another version of this embodiment, each arm has a widest portion and the clip has a widest portion, and the widest portions of the arms and the clip have substantially the same width. In another version of this embodiment, the widest portion of each arm is positioned near the widest portion of the clip. In another version of this embodiment, the device also includes a wallet configured to be held by the clip.

In another embodiment, the invention is a device that has a spring having an arcuate-shaped portion at one end and two arm-retaining portions; and an arm pivotally coupled to each arm-retaining portion. In one version of this embodiment, the spring also has a leverage bump that is contacted by one of the arms when the spring is opened. In another version of this embodiment, the spring also has two leverage bumps, and each arm contacts a leverage bump when the spring is opened. In another version of this embodiment, the leverage bump includes two outer portions and a middle portion, and the two outer portions protrude more outwardly from the spring than the middle portion. In another version of this embodiment, each leverage bump includes two outer portions and a middle portion, and the two outer portions of each leverage bump protrude more outwardly from the spring than the middle portion. In another version of this embodiment, each arm includes two hinge elements separated by two slots and a middle segment, and each hinge element has an elongated segment and a hinge segment. In another version of this embodiment, the hinge segments of a given arm fit at least partially within an arm-retaining portion of the spring. In another version of this embodiment, the hinge elements of each arm are longer than the middle segment of that arm. In another version of this embodiment, an edge of the middle segment of each arm is positioned near an arm-retaining portion of the spring. In another version of this embodiment, each arm has a widest portion and the spring has a widest portion, and the widest portions of the arms and the spring have substantially the same width. In another version of this embodiment, the widest portion of each arm is positioned near the widest portion of the spring. In another version of this embodiment, each arm includes an indention. In another version of this embodiment, each arm includes an insert in the indention. In another version of this embodiment, the device also includes a wallet configured to be held by the spring.

In another embodiment, the invention is a device that includes a clip having an outer surface; an outer element contacting the outer surface of the clip, the outer element having two ends; and an arm pivotally coupled to each end. In one version of this embodiment, one arm includes a protrusion, and the protrusion contacts the outer element when the clip is opened. In another version of this embodiment, the outer element includes two sides that are hinged together. In another version of this embodiment, the two sides are hinged together with a pin. In another version of this embodiment, each side includes an outer surface and a recessed portion in the outer surface. In another version of this embodiment, each arm includes a protrusion. In another version of this embodiment, each arm is pivotally coupled to an end with a pin. In another version of this embodiment, each arm includes a coupling portion that contacts the pin coupling that arm to an end. In another version of this embodiment, the outer element includes an inner surface that includes a recessed portion, and the clip contacts the recessed portion of the inner surface. In another version of this embodiment, where the outer element includes two sides that are coupled, each side has an inner surface, the inner surfaces of the sides together comprise the inner surface of the outer element, the inner surfaces of the two sides each include a recessed portion that is part of the recessed portion of the inner surface of the outer element, and the clip contacts the recessed portion of the inner surface of each of the two sides. In another version of this embodiment, the recessed portion of the inner surface of each side is bordered by two shoulder portions. In another version of this embodiment, each shoulder portion includes a groove into which a portion of the clip fits. In another version of this embodiment, each arm includes a coupling portion that contacts a pin hinging the arm to an end. In another version of this embodiment, each end includes a coupling portion that contacts the pin hinging an arm to the end. In another version of this embodiment, the clip includes a back portion and two retainer portions, each retainer portion having an upper retainer element and a lower retainer element, the upper and lower retainer elements of each retainer portion being separated by a holding element that extends farther from the back portion than either retainer element. In another version of this embodiment, the device includes a wallet configured to be held by the clip.

In another embodiment, the invention is a device that includes a clip; an outer element having a recess and two ends, a portion of the clip contacting a portion of the recess; and an arm pivotally coupled to each end with a pin. In one version of this embodiment, each arm includes a protrusion, and both protrusions contact the outer element when the clip is opened. In another version of this embodiment, the outer element includes an outer surface and two recessed portions in the outer surface. In another version of this embodiment, the device also includes a wallet configured to be held by the clip.

In another embodiment, the invention is a device that includes a clip having an outer surface; an outer element contacting the outer surface of the clip, the outer element having two sides, each side having two elongated elements defining between them an arm recess; and an arm pivotally coupled to each side of the outer element and positioned in an arm recess. In one version of this embodiment, one arm includes a leverage bump, and the leverage bump contacts the outer element when the clip is opened. In another version of this embodiment, each arm includes a leverage bump, and each leverage bump contacts the outer element when the clip is opened. In another version of this embodiment, one arm includes a leverage bump, one side includes a leverage bump, and the leverage bump of the arm contacts the leverage bump of the side when the clip is opened. In another version of this embodiment, each arm includes a leverage bump, each side includes a leverage bump, and the leverage bump of each arm contacts the leverage bump of a side when the clip is opened. In another version of this embodiment, the device also includes a wallet configured to be held by the clip.

In another embodiment, the invention is a device that includes a clip having two hinges positioned beside each other, each hinge having two outer open ends; and an arm pivotally coupled to each hinge, each arm including two hinge segments that are positioned at least partially within the two outer open ends of each hinge, one of the hinge segments having a non-circular cross-sectional profile. The device is sized to hold one or more of paper, cards and a wallet. In one version of this embodiment, the clip has a leverage bump positioned such that one of the arms contacts the leverage bump when the clip is opened. In another version of this embodiment, each arm has an elongated segment extending from the hinge segment of that arm; and, when the clip is opened, an elongated segment of a given arm contacts the clip before the given arm contacts the leverage bump. In another version of this embodiment, the clip has two leverage bumps, and each arm contacts a leverage bump when the clip is opened. In another version of this embodiment, the elongated segments of a given arm are separated by two slots and a middle segment. In another version of this embodiment, each arm has a hinge element that includes one of the elongated segments and one of the hinge segments, and the hinge element of a given arm is longer than the middle segment of the given arm. In another version of this embodiment, an edge of the middle segment of each arm is positioned near a hinge of the clip. In another version of this embodiment, each arm has a widest portion and the clip having a widest portion, and the widest portions of the arms and the clip have substantially the same width. In another version of this embodiment, the widest portion of each arm is positioned near the widest portion of the clip. In another version of this embodiment, each arm includes an indention. In another version of this embodiment, the indention of one of the arms protrudes outwardly so as to be closer to the leverage bump of the clip than any other portion of that arm when that arm is bent back and in contact with the leverage bump. In another version of this embodiment, the device also includes a wallet configured to be held by the clip.

In another embodiment, the invention is a device that includes a clip that is not substantially triangular in shape when in an empty closed position, the clip having two ends; and an arm pivotally coupled to each end. The device is sized to hold one or more of paper, cards and a wallet. In one version of this embodiment, each end has a hinge to which an arm is pivotally coupled. In another version of this embodiment, each arm includes two hinge segments that are positioned at least partially within the hinge to which that arm is pivotally coupled, and one of the hinge segments has a non-circular cross-sectional profile. In another version of this embodiment, the clip has a leverage bump positioned such that one of the arms contacts the leverage bump when the clip is opened. In another version of this embodiment, each arm has an elongated segment extending from the hinge segment of that arm; and, when the clip is opened, an elongated segment of a given arm contacts the clip before the given arm contacts the leverage bump. In another version of this embodiment, the clip has two leverage bumps, and each arm contacts a leverage bump when the clip is opened. In another version of this embodiment, the elongated segments of a given arm are separated by two slots and a middle segment. In another version of this embodiment, each arm has a hinge element that includes one of the elongated segments and one of the hinge segments, and the hinge element of a given arm are longer than the middle segment of the given arm. In another version of this embodiment, an edge of the middle segment of each arm is positioned near a hinge of the clip. In another version of this embodiment, each arm has a widest portion and the clip having a widest portion, and the widest portions of the arms and the clip have substantially the same width. In another version of this embodiment, the widest portion of each arm is positioned near the widest portion of the clip. In another version of this embodiment, each arm includes an indention. In another version of this embodiment, the indention of one of the arms protrudes outwardly so as to be closer to the leverage bump of the clip than any other portion of that arm when that arm is bent back and in contact with the leverage bump. In another version of this embodiment, the device also includes a wallet configured to be held by the clip. In another version of this embodiment, each arm is a non-wire frame arm.

In another embodiment, the invention is a device that includes a clip that has an open position that includes two substantially parallel sides connected by an arch, the clip also having two ends; and an arm pivotally coupled to each end. The device is sized to hold one or more of paper, cards and a wallet. In one version of this embodiment, each arm is a non-wire frame arm. In another version of this embodiment, each end has a hinge to which an arm is pivotally coupled. In another version of this embodiment, each arm includes two hinge segments that are positioned at least partially within the hinge to which that arm is pivotally coupled, and one of the hinge segments having a non-circular cross-sectional profile. In another version of this embodiment, the clip has a leverage bump positioned such that one of the arms contacts the leverage bump when the clip is opened. In another version of this embodiment, each arm has an elongated segment extending from the hinge segment of that arm; and, when the clip is opened, an elongated segment of a given arm contacts the clip before the given arm contacts the leverage bump. In another version of this embodiment, the clip has two leverage bumps, and each arm contacts a leverage bump when the clip is opened. In another version of this embodiment, the elongated segments of a given arm are separated by two slots and a middle segment. In another version of this embodiment, each arm has a hinge element that includes one of the elongated segments and one of the hinge segments, and the hinge element of a given arm are longer than the middle segment of the given arm. In another version of this embodiment, an edge of the middle segment of each arm is positioned near a hinge of the clip. In another version of this embodiment, each arm has a widest portion and the clip having a widest portion, and the widest portions of the arms and the clip have substantially the same width. In another version of this embodiment, the widest portion of each arm is positioned near the widest portion of the clip. In another version of this embodiment, each arm includes an indention. In another version of this embodiment, the indention of one of the arms protrudes outwardly so as to be closer to the leverage bump of the clip than any other portion of that arm when that arm is bent back and in contact with the leverage bump. In another version of this embodiment, the device also includes a wallet configured to be held by the clip.

In another embodiment, the invention is a device that includes a clip having two arm-retaining portions that are positioned beside each other when the clip is in an empty closed position; and a non-wire frame arm pivotally coupled to each arm-retaining portion. Each arm-retaining portion and the non-wire frame arm pivotally coupled to that arm-retaining portion are configured such that the non-wire frame arms snap into position as they are moved from a bent-back position to a closed position. The device is sized to hold one or more of paper, cards and a wallet. In one version of this embodiment, the clip has an open position that includes two substantially parallel sides connected by an arch, and the arm-retaining portions of the clip define two ends of the clip. In another version of this embodiment, each arm includes two hinge segments that are positioned at least partially within the arm-retaining portion to which that arm is pivotally coupled, and one of the hinge segments has a non-circular cross-sectional profile. In another version of this embodiment, the clip has a leverage bump positioned such that one of the arms contacts the leverage bump when the clip is opened. In another version of this embodiment, each arm has an elongated segment extending from the hinge segment of that arm; and, when the clip is opened, an elongated segment of a given arm contacts the clip before the given arm contacts the leverage bump. In another version of this embodiment, the clip has two leverage bumps, and each arm contacts a leverage bump when the clip is opened. In another version of this embodiment, the elongated segments of a given arm are separated by two slots and a middle segment. In another version of this embodiment, each arm has a hinge element that includes one of the elongated segments and one of the hinge segments, and the hinge element of a given arm are longer than the middle segment of the given arm. In another version of this embodiment, an edge of the middle segment of each arm is positioned near a hinge of the clip. In another version of this embodiment, each arm has a widest portion and the clip having a widest portion, and the widest portions of the arms and the clip have substantially the same width. In another version of this embodiment, the widest portion of each arm is positioned near the widest portion of the clip. In another version of this embodiment, each arm includes an indention. In another version of this embodiment, the indention of one of the arms protrudes outwardly so as to be closer to the leverage bump of the clip than any other portion of that arm when that arm is bent back and in contact with the leverage bump. In another version of this embodiment, the device also includes a wallet configured to be held by the clip.

In another embodiment, the invention is a device that includes a clip that has (a) a main portion, (b) two hinges that define a first end, and (c) a second end; and an arm pivotally coupled to each hinge. The clip and arms are configured such that when force is applied to begin opening the clip, contact between a given arm and the main portion of the clip occurs at a location that is closer to the first end than to the second end, and the clip will begin to open before any contact between the given arm and the main portion of the clip occurs at a second location that is closer to the second end than the first end. The device is sized to hold one or more of paper, cards and a wallet. In one version of this embodiment, each arm is a non-wire frame arm. In another version of this embodiment, each arm includes two hinge segments that are positioned at least partially within the hinge to which that arm is pivotally coupled, and one of the hinge segments has a non-circular cross-sectional profile. In another version of this embodiment, the clip has a leverage bump positioned such that one of the arms contacts the leverage bump when the clip is opened. In another version of this embodiment, each arm has an elongated segment extending from the hinge segment of that arm; and, when the clip is opened, an elongated segment of a given arm contacts the clip before the given arm contacts the leverage bump. In another version of this embodiment, the clip has two leverage bumps, and each arm contacts a leverage bump when the clip is opened. In another version of this embodiment, the elongated segments of a given arm are separated by two slots and a middle segment. In another version of this embodiment, each arm has a hinge element that includes one of the elongated segments and one of the hinge segments, and the hinge element of a given arm are longer than the middle segment of the given arm. In another version of this embodiment, an edge of the middle segment of each arm is positioned near a hinge of the clip. In another version of this embodiment, each arm has a widest portion and the clip having a widest portion, and the widest portions of the arms and the clip have substantially the same width. In another version of this embodiment, the widest portion of each arm is positioned near the widest portion of the clip. In another version of this embodiment, each arm includes an indention. In another version of this embodiment, the indention of one of the arms protrudes outwardly so as to be closer to the leverage bump of the clip than any other portion of that arm when that arm is bent back and in contact with the leverage bump. In another version of this embodiment, the device also includes a wallet configured to be held by the clip.

In another embodiment, the invention is a device that includes a clip having two ends; and an arm pivotally coupled to each end, each arm having a length and being bowed along the length. The device is sized to hold one or more of paper, cards and a wallet. In one version of this embodiment, each arm is a non-wire frame arm. In another version of this embodiment, each end has a hinge to which an arm is pivotally coupled. In another version of this embodiment, each arm includes two hinge segments that are positioned at least partially within the hinge to which that arm is pivotally coupled, and one of the hinge segments having a non-circular cross-sectional profile. In another version of this embodiment, the clip has a leverage bump positioned such that one of the arms contacts the leverage bump when the clip is opened. In another version of this embodiment, each arm has an elongated segment extending from the hinge segment of that arm; and, when the clip is opened, an elongated segment of a given arm contacts the clip before the given arm contacts the leverage bump. In another version of this embodiment, the clip has two leverage bumps, and each arm contacts a leverage bump when the clip is opened. In another version of this embodiment, the elongated segments of a given arm are separated by two slots and a middle segment. In another version of this embodiment, each arm has a hinge element that includes one of the elongated segments and one of the hinge segments, and the hinge element of a given arm are longer than the middle segment of the given arm. In another version of this embodiment, an edge of the middle segment of each arm is positioned near a hinge of the clip. In another version of this embodiment, each arm has a widest portion and the clip having a widest portion, and the widest portions of the arms and the clip have substantially the same width. In another version of this embodiment, the widest portion of each arm is positioned near the widest portion of the clip. In another version of this embodiment, each arm includes an indention. In another version of this embodiment, the indention of one of the arms protrudes outwardly so as to be closer to the leverage bump of the clip than any other portion of that arm when that arm is bent back and in contact with the leverage bump. In another version of this embodiment, the device also includes a wallet configured to be held by the clip.

Other embodiments of the present devices are described below.

BRIEF DESCRIPTION OF THE DRAWINGS

The following drawings demonstrate certain aspects of the present devices. They illustrate by way of example and not limitation. The embodiments of the present devices depicted in the drawings are to scale unless otherwise noted. The paper positioned around the wallets depicted in certain of the present figures is a generic representation of U.S. dollars that is not to scale.

FIG. 28O is a view of the detail circled in FIG. 28N.

FIGS. 37–42 are inside (side), outside (side), end, top, outside perspective, and inside perspective views, respectively, of a version of one of the present arms that has an outwardly protruding indention.

DESCRIPTION OF ILLUSTRATIVE EMBODIMENTS

The terms "comprise" (and any form of comprise, such as "comprises" and "comprising"), "have" (and any form of have, such as "has" and "having"), and "include" (and any form of include, such as "includes" and "including") are open-ended linking verbs. Thus, a device "comprising" a clip having two ends and a leverage bump, and an arm coupled to each end is a device that possesses such a clip and such arms, but is not limited to possessing those items. For example, the device may also possess a wallet configured to be held by the clip. Likewise, a clip "having" two ends and a leverage bump possesses those features, but is not excluded from possessing additional features such as an additional leverage bump.

The terms "a" and "an" mean one or more than one. The term "another" means at least a second or more.

Those of skill in the art will appreciate that in the detailed description below, certain well known manufacturing and assembly techniques have been omitted so that the present devices are not obscured in unnecessary detail. Similarly, some features of the some of the devices have not been labeled in all of the drawings, so that the drawings are not unnecessarily cluttered. Any dimensions provided in English units may be translated to the corresponding metric unit by rounding to the nearest millimeter.

Figure 1:
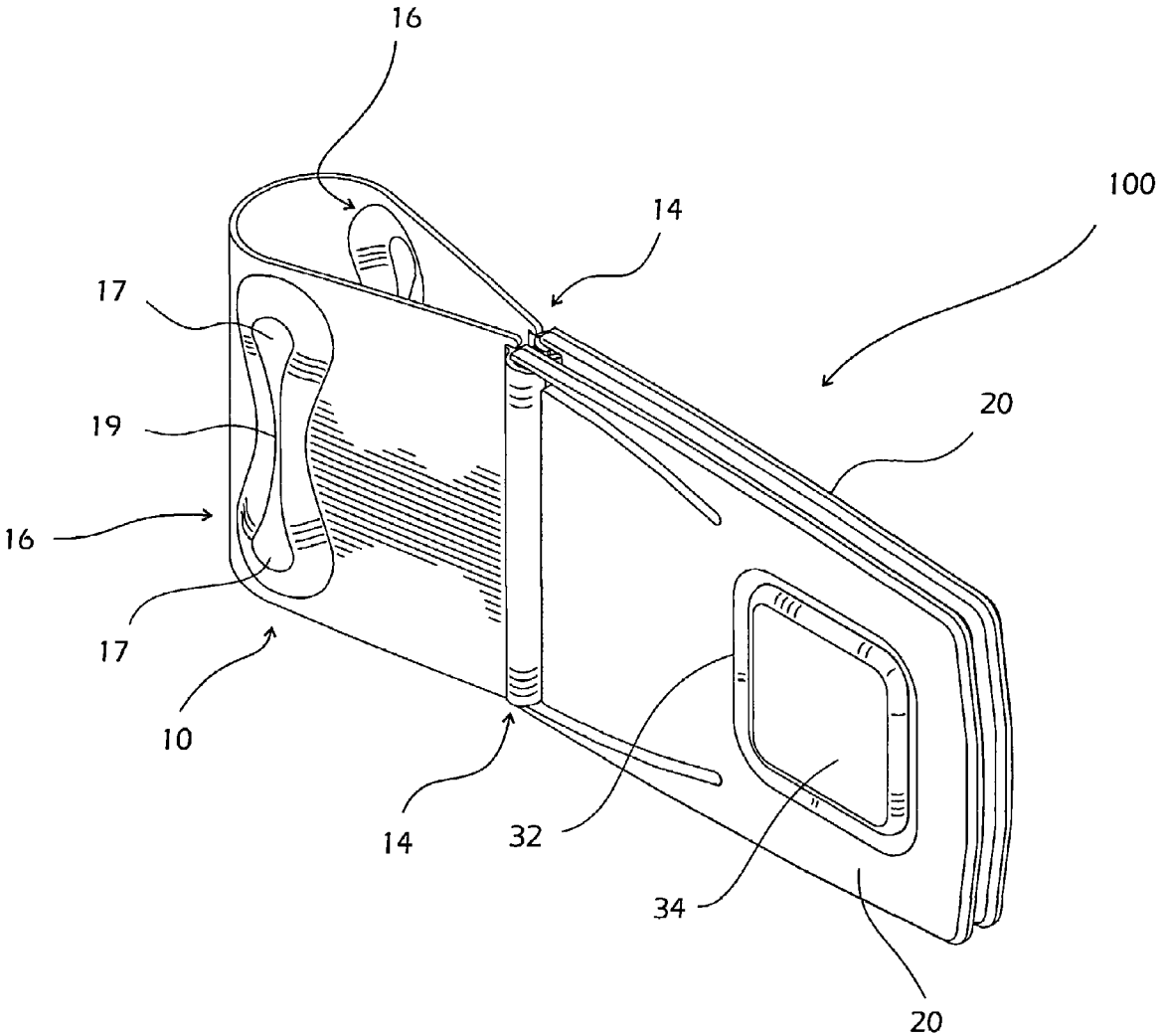
FIG. 1 is a perspective view of one of the present devices.
Figure 8:
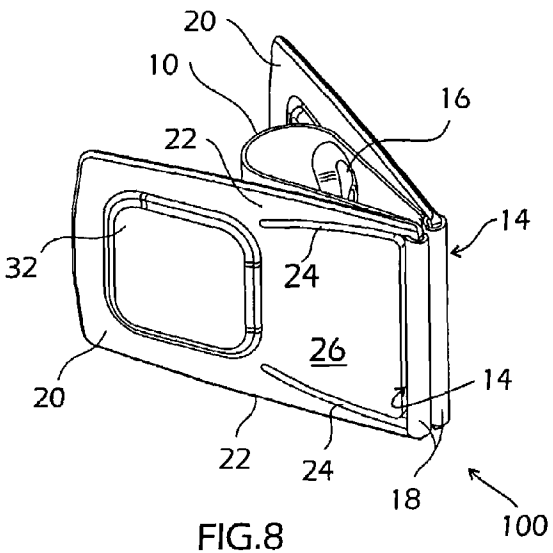
FIG. 8 is a perspective view of the device shown in FIG. 1, where the arms of the device are bent back, but the clip of the device is not open.
Figure 9:
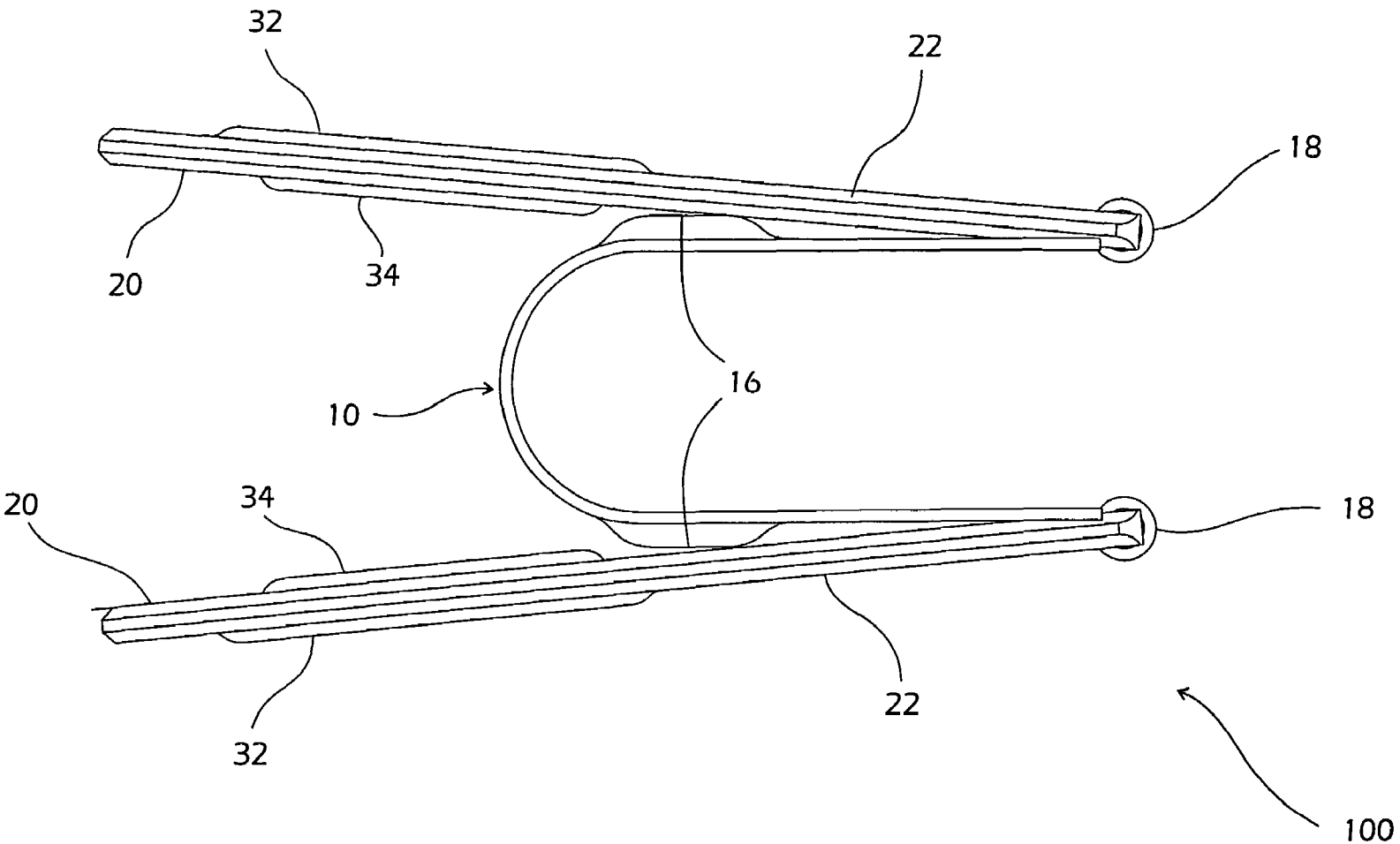
FIG. 9 is a top view of the device shown in FIG. 1, depicting that device in an opened position.
Figure 10:
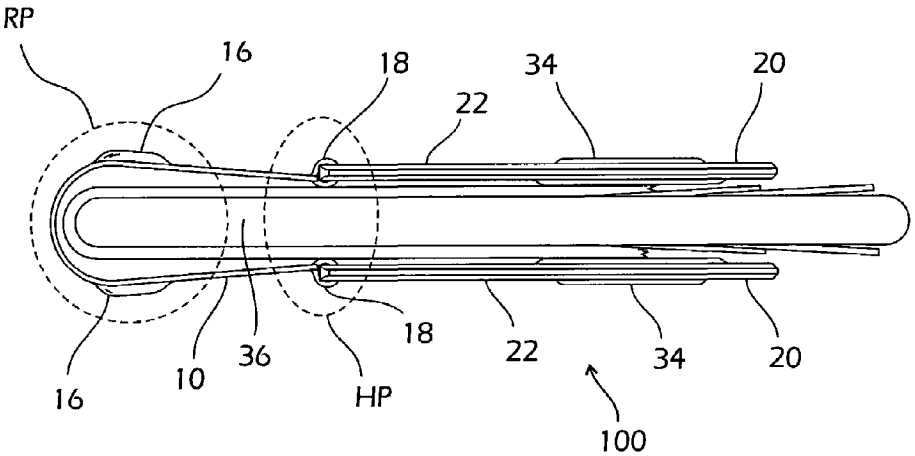
FIG. 10 is a top view of the device shown in FIG. 1, showing that the device can include a wallet.

FIGS. 1–9 show different views of one of the present devices. FIG. 10 shows that the device depicted in FIGS. 1–9 may include a wallet. Turning first to FIG. 1, device 100 includes a clip 10 having two ends 14 and a leverage bump 16. More specifically, clip 10 shown in FIG. 1 includes two leverage bumps 16. Device 100 also includes an arm 20 that is pivotally coupled to each end 14. As will be shown in another figure and described below, one of the arms of device 100 contacts a leverage bump when the clip is opened. More specifically, in the embodiment shown in FIG. 1, each arm 20 will contact a leverage bump 16 when clip 10 is opened. Arms 20—as well as arms 50, 80, 430, and 530—are examples of non-wire frame arms. In contrast, the following patents disclose only arms with wire frames: U.S. Pat. Nos. D321,209; D321,210; 1,139,627; 1,150,073; 4,332,060; 4,402,530; 4,532,680; 4,761,862; 5,249,336 (shows wire frame covered with a sleeve); U.S. Pat. Nos. 5,533,236; 5,896,624; and 6,327,749. Clip 10 may be characterized as a clip that is not substantially triangular in shape when in an empty (nothing in it) closed position, as shown for example in FIGS. 1 and 5. In contrast, the following patents and application disclose only clips that are substantially triangular in shape when in an empty closed position: U.S. Pat. Nos. D321,209; D321,210; D372,498; D485,780; 1,139,627; 1,150,073; 4,332,060; 4,402,530; 4,532,680; 4,761,862; 5,249,336; 5,533,236; 5,896,624; 6,327,749; and U.S. patent application Ser. No. 10/060,942 filed Jan. 30, 2002 in the name of Chip Thomson.

Clip 10 of device 100 in FIGS. 1–10, as well as clip 10 in devices 200 and 300 depicted in FIGS. 11–16, may also be referred to in this document (including the claims) as a spring. The leverage bump that are part of the present clips may be any suitable shape configured to contact the present arms when those clips are opened. The present leverage bumps may be formed by placing extra material on a clip that has already been created and attaching that material to the clip in any suitable fashion, such as through the use of an adhesive, heat, pressure, soldering, welding, or any combination of these. Alternatively, the present leverage bumps may be created with the clips as the clips are formed. For example, the leverage bumps shown throughout FIGS. 1–16 may be stamped out such that they protrude outwardly from the outside of the clips and have a corresponding indention on the inside of the clips.

A version of a suitable leverage bump for use with the present clips is shown generally in FIGS. 1–16. Each leverage bump 16 includes two outer portions 17 and a middle portion 19. As shown in the figures, and most clearly in, for example, FIG. 3, outer portions 17 protrude more outwardly from clip 10 than does middle portion 19. Suitable exemplary thicknesses for the material that may be used to make certain embodiments of clip 10 include spring steel having a thickness of 0.025 inches to 0.018 inches.

In the embodiment of the present devices shown in FIGS. 1–10, arms 20 each include an indention 32 and an insert 34 contacting, or otherwise positioned in, the indention. The shape of the indention may be created to match the shape of the insert. However, while both may have flat surfaces to facilitate attachment of the two, indention 32 may have a slightly different shape than an insert 34 placed in it, as shown in these figures. Suitable exemplary thicknesses for the material that may be used to make certain embodiments of clip 10 include 0.048 inches to 0.062 inches.

Figure 5:
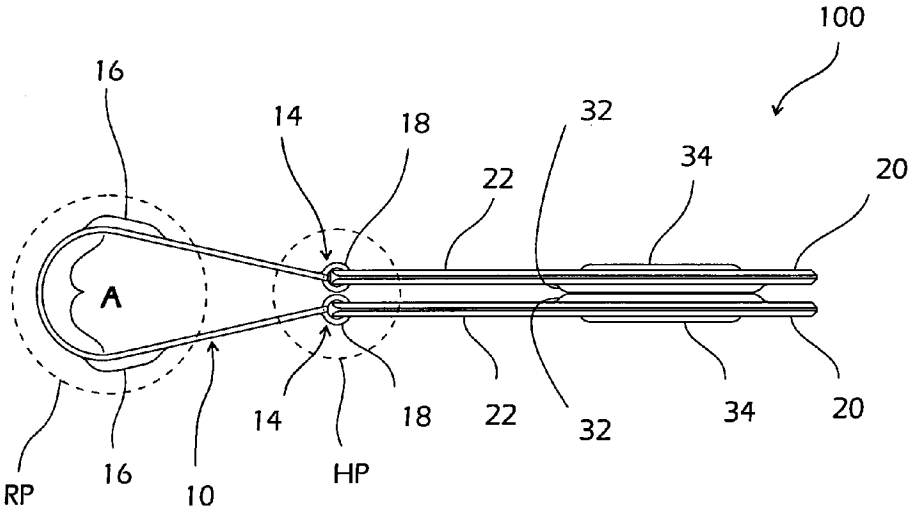
FIG. 5 is a top view of the device shown in FIG. 1.
Figure 2:
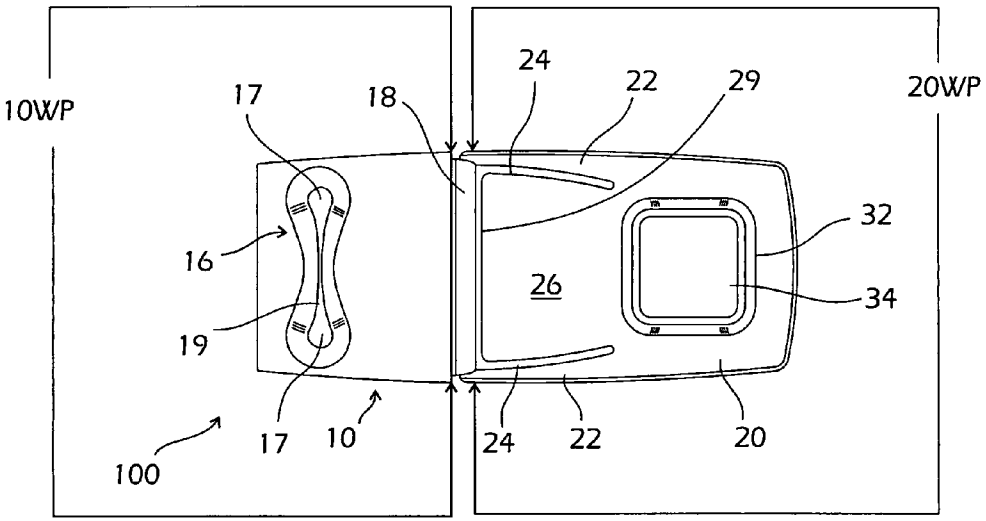
FIG. 2 is a side view of the device shown in FIG. 1.
Figure 6:
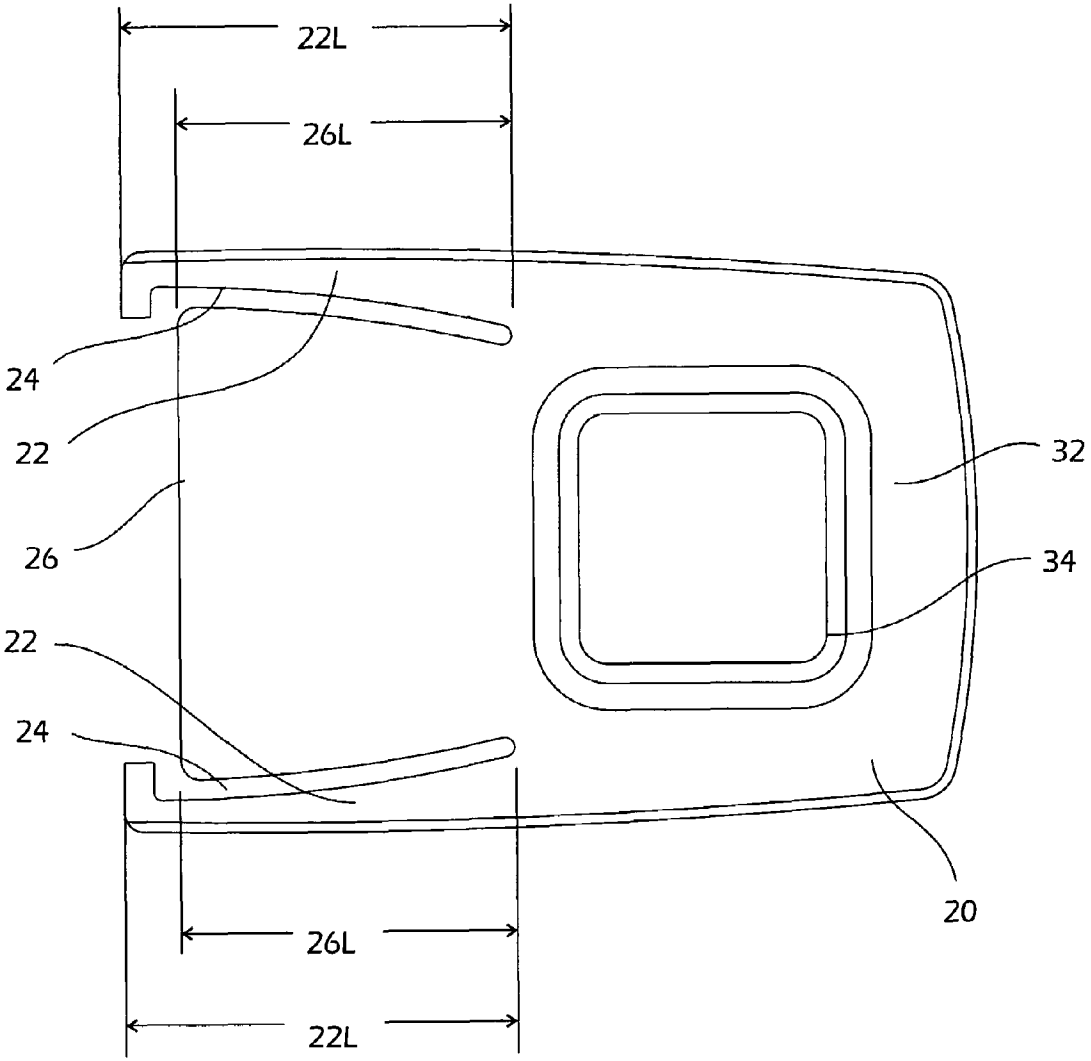
FIG. 6 is a side view of an arm of the device shown in FIG. 1.
Figure 7:
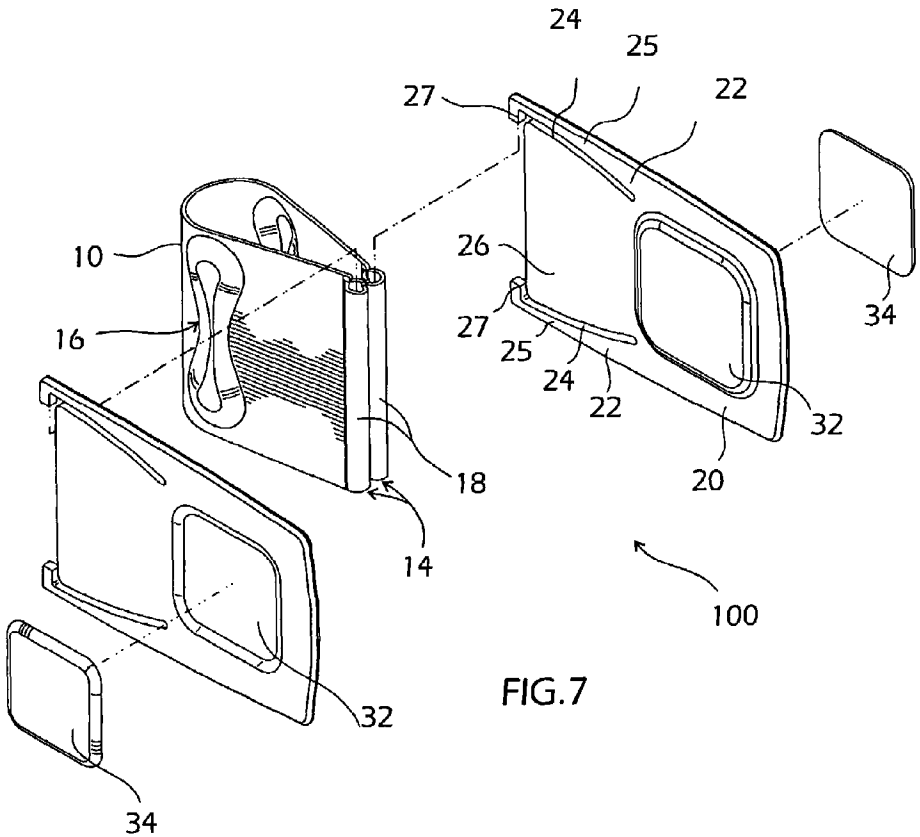
FIG. 7 is an exploded view of the elements of the device shown in FIG. 1, viewed in perspective.

FIG. 2 is a side of the device shown in FIG. 1. FIG. 2 shows that each arm 20 includes two hinge elements 22 that are separated by two slots 24 and a middle segment 26. As shown in FIGS. 6 and 7, each hinge element 22 has an elongated segment 25 and a hinge segment 27. As shown in FIGS. 2, 5, 7 and 8, each end 14 of clip 10 includes an arm-retaining portion 18. These portions may also be characterized as hinges 18. The arm-retaining portions 18 of clip 10 are positioned beside each when clip 10 is in an empty closed position, as it is in FIGS. 1 and 5. The arm-retaining portions are cylindrical in shape and are unbroken along their lengths, which respectively span substantially the entire width of clip 10. The term "substantially" is defined as at least close to (and can include) a given value or state (preferably within 10% of, more preferably within 1% of, and most preferably within 0.1% of). A suitable diameter for the cylinder shape of one embodiment of hinge 18 is 0.085 inches inner diameter. Each arm-retaining portion, or hinge, also has two outer open ends. As shown schematically in FIG. 7, the hinge segments 27 of a given arm 20 are designed to be placed in one of the two arm-retaining portions of clip 10. As a result of that placement, and as shown in FIGS. 1, 2, and 8, the hinge segments are located, or positioned, at least partially within the arm-retaining portion in which they are placed (the hinge segments are not labeled in these figures). The result of that placement may also be characterized as positioning the hinge segments at least partially within the two outer open ends of each hinge. Those hinge segments may have a non-circular cross-sectional profile, as does hinge segment 57 shown in FIGS. 57A–57D.

Figure 4:
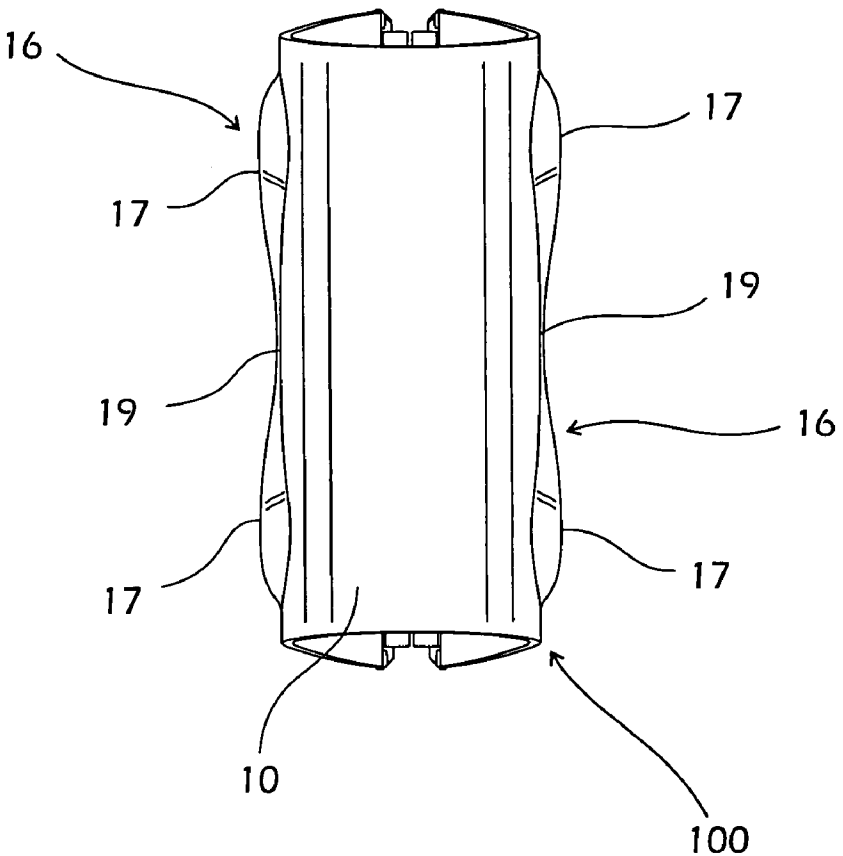
FIG. 4 is a back view of the device shown in FIG. 1.
Figure 3:
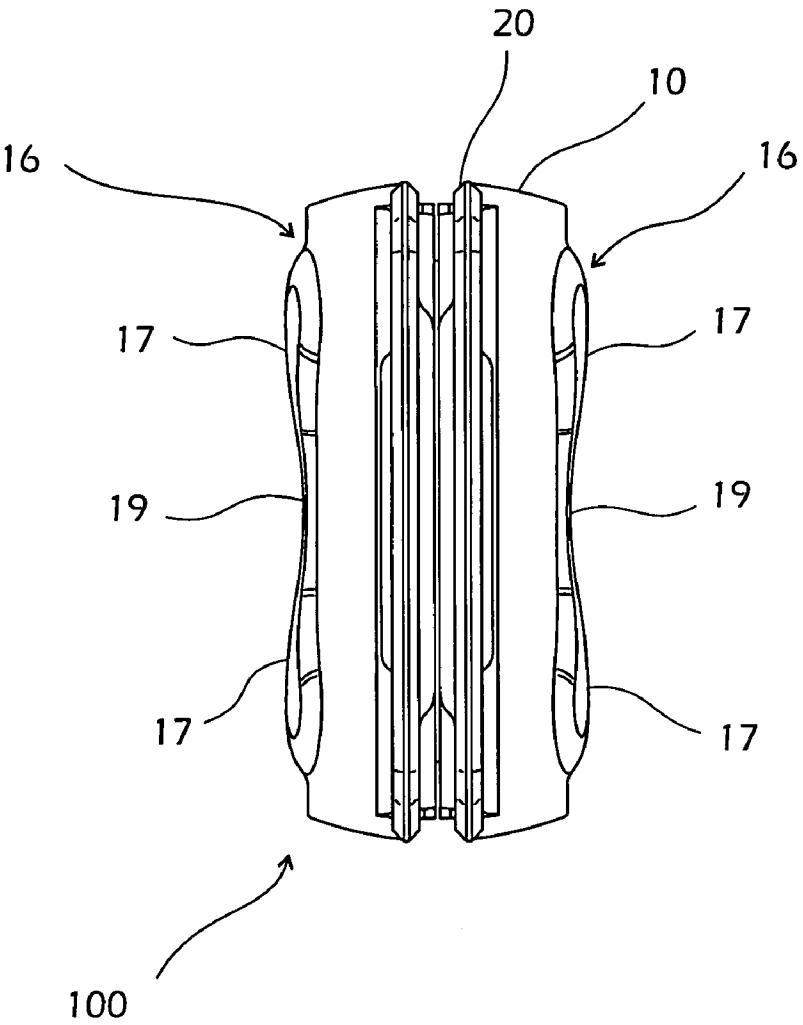
FIG. 3 is a front view of the device shown in FIG. 1.

FIGS. 3 and 4 show what device 100 looks like from the front and back, respectively. FIG. 5 shows what device 100 looks like from the top. FIG. 7 schematically shows how the elements of device 100 fit together. FIG. 6 shows a side view of handle 20 of device 100. FIG. 8 shows a perspective view of device 100, where arms 20 have been folded back, but clip 10 has not yet been opened.

FIG. 6 shows that the hinge elements 22 of arm 20 of device 100 may be longer than the middle segment 26 of that arm. Specifically, hinge elements 22 are shown having a length 22L that is greater than length 26L of middle segment 26. A suitable distance for the length of the entirety of one embodiment of arm 20 is 2.275 inches.

Returning to FIG. 2, middle segment 26 includes an edge 29 that is positioned near arm-retaining portion 18 of clip 10. This may be true of the middle segments of both arms 20 of device 100, although only one arm 20 is visible in FIG. 2. FIG. 2 also shows that each arm 20 of device 100 has a widest portion 20WP that has substantially the same width as the widest portion 10WP of clip 10. A suitable distance for 10WP of one embodiment of clip 10 is 1.481 inches, and a suitable distance for 20WP of one embodiment of arm 20 is 1.485 inches. Although the widest portions of the present clips and arms may be positioned anywhere along the lengths of those items, FIG. 2 shows that, in one embodiment, widest portion 20WP of each arm 20 is positioned near widest portion 10WP of clip 10.

The indentions of the arms of the devices shown in FIGS. 1–16 are positioned such that the inserts in those indentions (or the indentions themselves) do not contact the leverage bumps when the clips are opened. This is shown, for example, in FIG. 9, which depicts clip 10 in an open position. In other embodiments, however, the inserts and indentions may be positioned in the arms so as to contact the leverage bumps when a given clip is opened. FIG. 9 also illustrates that clip 10 is one example of a clip that has an open position that includes two substantially parallel sides connected by an arch. In contrast, the following patents and application disclose only clips that lack an open position that includes two substantially parallel sides connected by an arch: U.S. Pat. Nos. D321,209; D321,210; D372,498; D485,780; 1,139,627; 1,150,073; 4,332,060; 4,402,530; 4,532,680; 4,761,862; 5,249,336; 5,533,236; 5,896,624; 6,327,749; and U.S. patent application Ser. No. 10/060,942 filed Jan. 30, 2002 in the name of Chip Thomson.

One advantage of the present leverage bumps is that they may isolate the wear on the present clips that results from repeated opening of the clips, provided the leverage bumps are sized and positioned so that the contact between the arms of the present devices and the clips of the present devices occurs at the leverage bumps. In this way, the leverage bumps can be thought of as the isolation points for the inevitable wear on the clips of the present devices.

FIG. 10 is a top view of device 100, and shows that device 100 may include a wallet 36 that is effectively held by clip 10, and more specifically holding portion HP of clip 10. Holding portion HP of clip 10, shown in FIGS. 5 and 10, may include at least arm-retaining portions 18 of ends 14. Wallet 36 may have a back end positioned against the inside of clip 10 such that the rear portion of wallet 36 may be described as being received in receiving portion RP of clip 10 (see FIGS. 5 and 10). FIG. 5 shows that receiving portion RP of clip 10, or spring 10, may include an arch A. A suitable diameter for one embodiment of that arch is 0.5 inches. Furthermore, clip 10, or spring 10, may be referred to in this document (including the claims) as having an arcuate shaped portion (such as arch A) at one end of the clip, and two arm-retaining portions 18.

The clips, or springs, 10 shown in FIGS. 1–16, all have the same configuration. Thus, the details of clips 10—such as the leverage bumps, the receiving and holding portions, the arm-retaining portions, etc.—are not labeled in FIGS. 12 and 14. The arms shown in FIGS. 11–13, in FIGS. 14–16 and in FIGS. 58–62 are shaped differently (although they include the same features) from the arms shown in FIGS. 1–10. Accordingly, these alternative arms have been given new element numbers in FIGS. 11–16 and 58–62. The last digit of these new element numbers remains the same of the last digit of the corresponding element number from the arms in FIGS. 1–10, except the first digit has been increased by 30 in FIGS. 11–13, by 60 in FIGS. 14–16, and by 90 in FIGS. 58–62. Although the hinge segments of the arms of device 600 shown in FIGS. 58–62 exist, they are not visible in those figures. The arms 110 in FIGS. 58–62 may be described as having a length (the length running from edge 119 to the forwardmost end of the arm (i.e., the portion of the arm farthest from the clip when device 600 is in an empty closed position)) and being bowed along the length.

Figure 13:
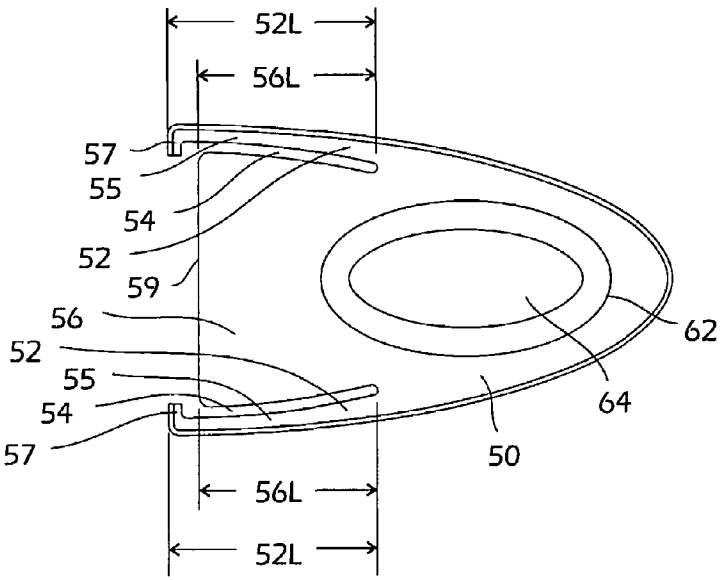
FIG. 13 is a side view of an arm of the device shown in FIG. 11.
Figure 12:
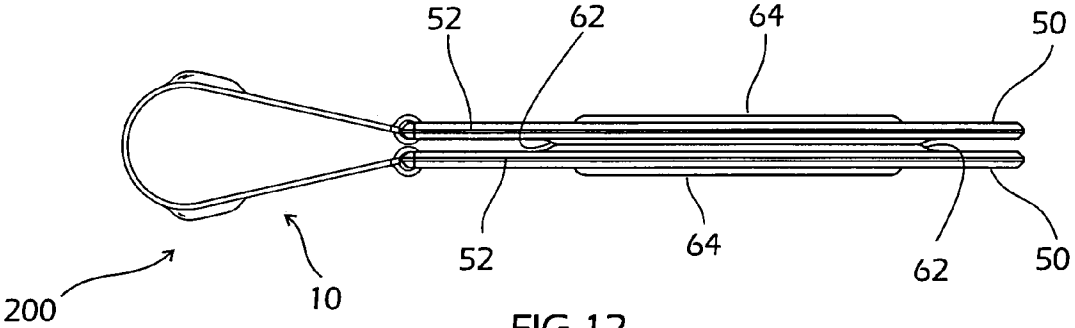
FIG. 12 is a top view of the device shown in FIG. 11.
Figure 11:
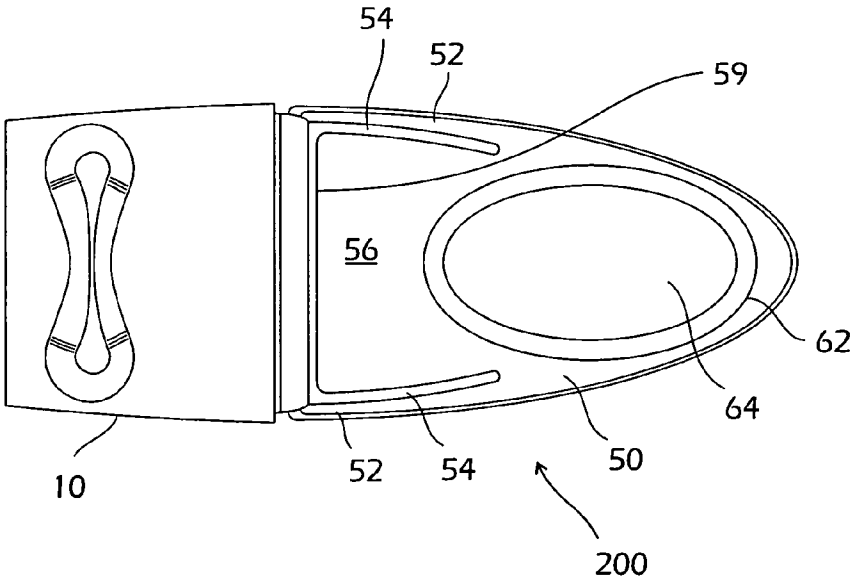
FIG. 11 is a side view of another of the present devices.

Arms 50 of device 200 depicted in FIGS. 11 and 12 include indentions 62 and inserts 64. Arms 50 of device 200 also each include two hinge elements 52 separated by two slots 54 and a middle segment 56. As shown in FIG. 13, each hinge element 52 includes an elongated segment 55 and a hinge segment 57. The hinge segment 57 of a given arm 50 are designed to fit at least partially within the arm-retaining portion 18 (or at least partially within the open ends of the arm-retaining portion 18) of an end 14 of clip 10. Furthermore, as with hinge elements 22 and middle segments 26 of arms 20, the hinge elements 52 of each arm 50 are longer than the middle segment 56 of each arm. This is illustrated in FIG. 13 by hinge element 52 having a linked 52L that is greater than the length 56L of middle segment 56.

Figure 57C:
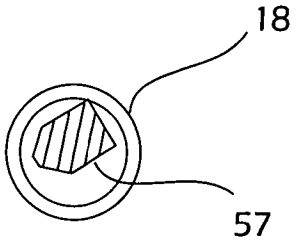
FIGS. 57A–57D are a series of views showing one of the present hinges and the position—during the process of closing the arms—of a cross-sectionally depicted portion of one of the present hinge segments that is positioned at least partially within that hinge (e.g., within an outer open end of the same).
Figure 57D:
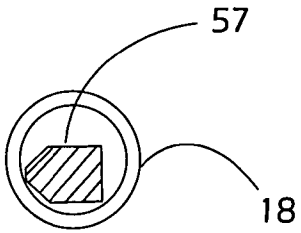
Figure 57A:
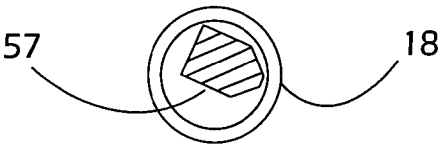
Figure 57B:
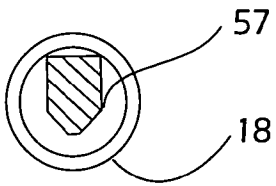
Figure 62:
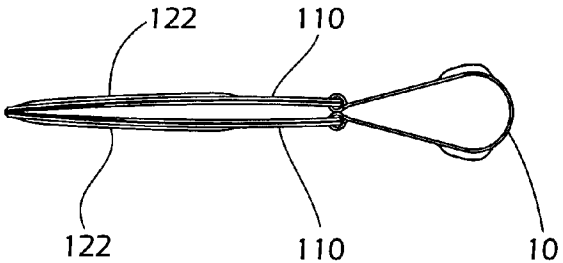
FIG. 62 is a top view of the device shown in FIG. 58.
Figure 61:
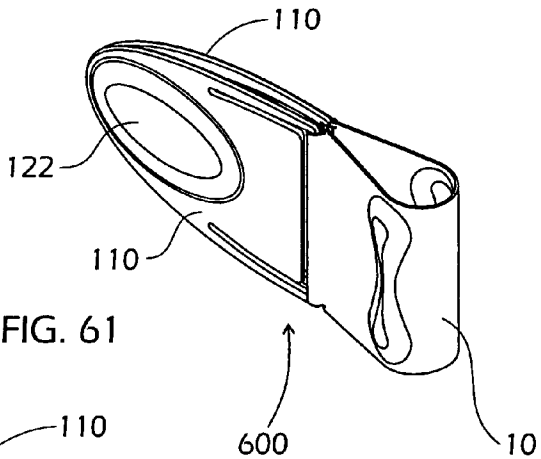
FIG. 61 is a rear perspective view of the device shown in FIG. 58.
Figure 58:
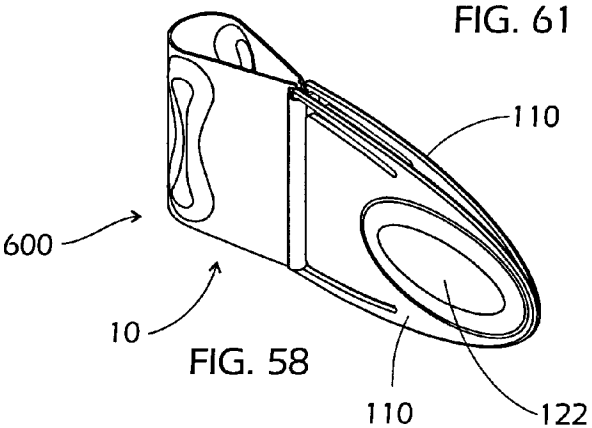
FIG. 58 is a perspective view of one of the present devices that has bowed arms.
Figure 59:
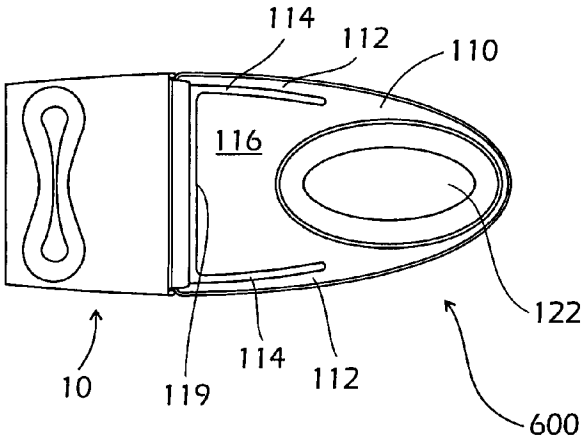
FIG. 59 is a side view of the device shown in FIG. 58.
Figure 60:
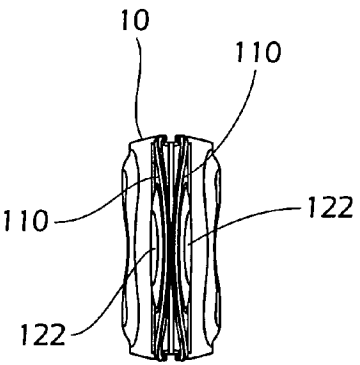
FIG. 60 is a front view of the device shown in FIG. 58.

The arm-retaining portions, or hinges, of the present clips 10 and the arms (e.g., the non-wire frame arms) that are, respectively, pivotally coupled to them may be collectively configured such that those arms snap into position as they (i.e., those arms) are moved from a bent-back position (see, e.g., FIG. 8) to a closed position (see, e.g., FIGS. 1 and 5). Such a configured hinge and non-wire frame arm are shown in FIGS. 57A–57D, which are a series of views showing a hinge 18 and the position during the process of closing the arms of a cross-sectionally depicted portion of a hinge segment 57 positioned at least partially within that hinge (e.g., within an outer open end of the same). FIG. 57A shows the position of hinge segment 57 when the arm of which it is a part is in a bent-back position; FIG. 57B shows the position of hinge segment 57 when the arm of which it is at a 90-degree angle to the length of the clip; FIG. 57C shows the position of hinge segment 57 when the arm of which it is a part is just about to snap closed; and FIG. 57D shows the position of hinge segment 57 when the arm of which it is a part has snapped into the empty closed position.

FIGS. 37–42 are inside (side), outside (side), end, top, outside perspective, and inside perspective views, respectively, of a version of arm 50 that includes an indention 62 that protrudes outwardly from the outside of arm 50 such that indention 62 will contact a leverage bump of a clip having a leverage bump at some point during the process of opening the clip as far as it will open. No insert is provided in this embodiment of arm 50.

FIGS. 43–48 are inside (side), outside (side), end, top, outside perspective, and inside perspective views, respectively, of another version of arm 50 that includes an indention 62 that protrudes outwardly from the outside of arm 50 such that indention 62 will contact a leverage bump of a clip having a leverage bump at some point during the process of opening the clip as far as it will open. The edge of indention 62—judged from the outside of arm 50—is closer to the edge of the forwardmost end of the arm than the same edge of indention 62 in FIGS. 37–42. No insert is provided in this embodiment of arm 50.

Figure 15:
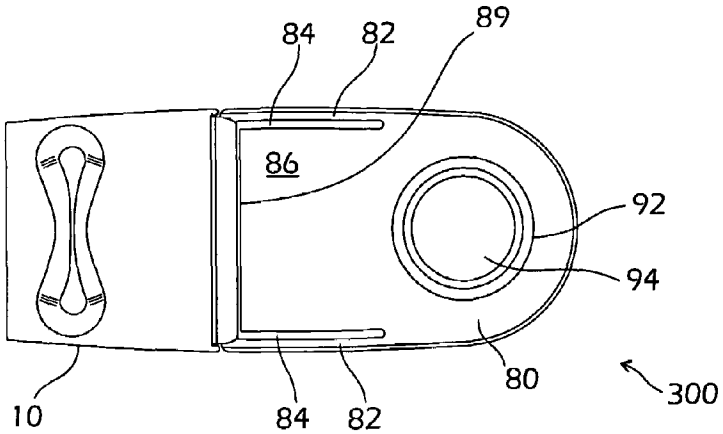
FIG. 15 is a top view of the device shown in FIG. 14.
Figure 16:
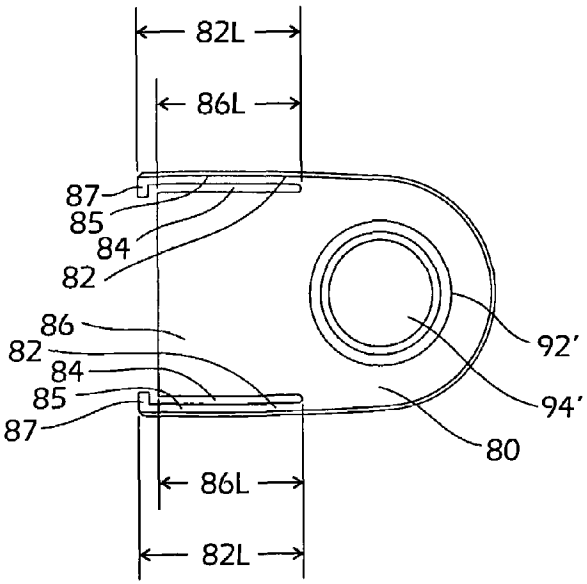
FIG. 16 is a side view of an arm of the device shown in FIG. 14.
Figure 14:
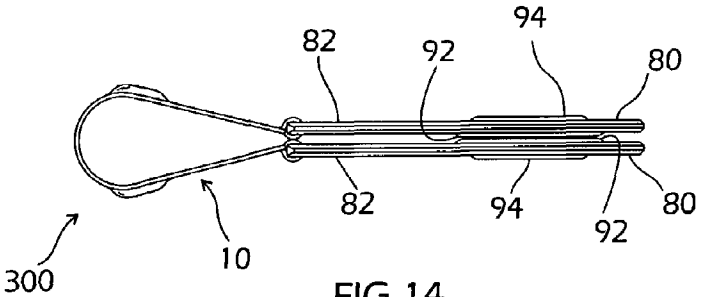
FIG. 14 is a side view of another of the present devices.
Figure 21:
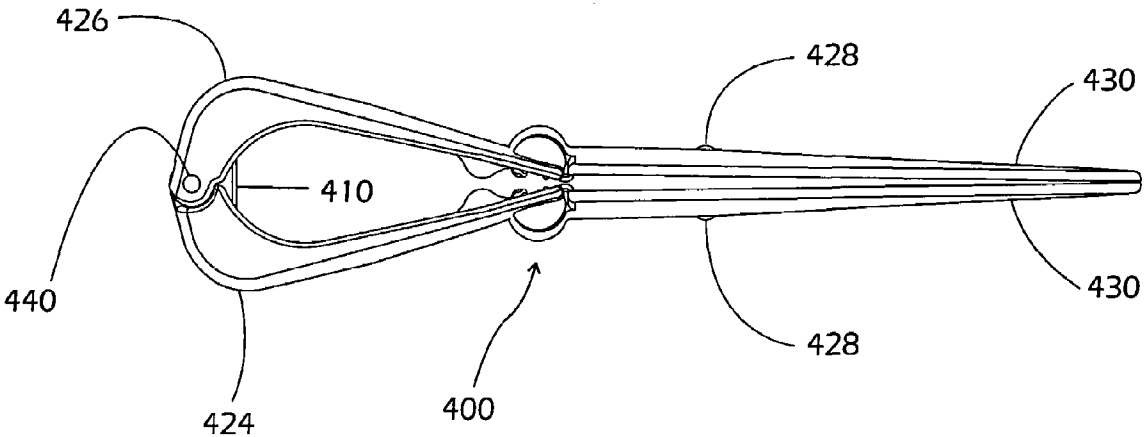
FIG. 21 is a top view of the device shown in FIG. 17.
Figure 17:
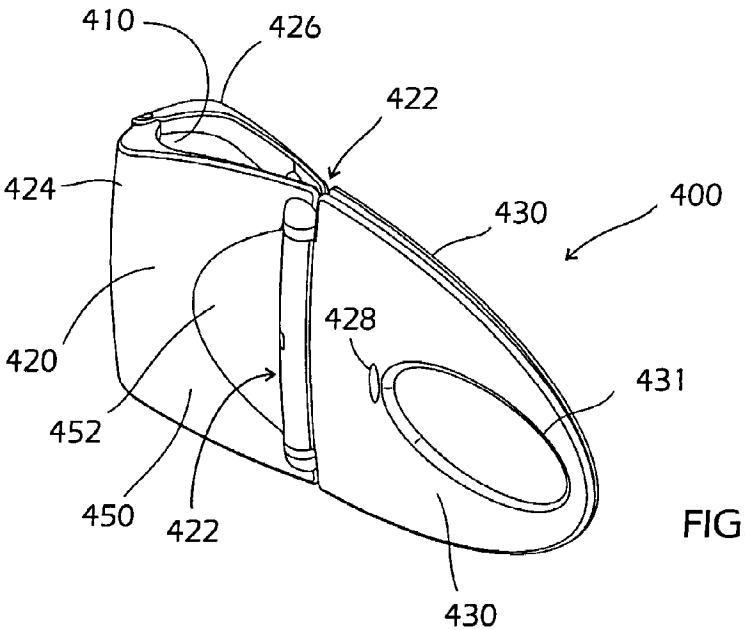
FIG. 17 is a perspective view of another of the present devices.
Figure 18:
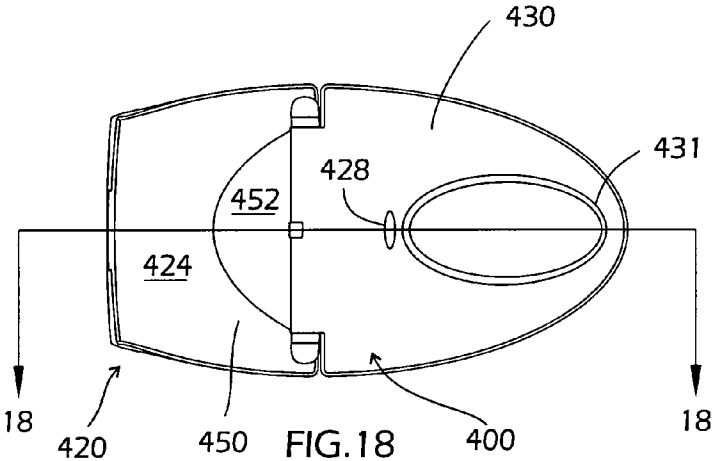
FIG. 18 is a side view of the device shown in FIG. 17.

Arms 80 of device 300 depicted in FIGS. 14 and 15 include indentions 92 and inserts 94. The same indention and insert are labeled with 92' and 94', respectively, in FIG. 16, because the sizes of the two features is slightly different in FIG. 16. Arms 80 of device 300 also each include two hinge elements 82 separated by two slots 84 and a middle segment 86. As shown in FIG. 16, each hinge element 82 includes an elongated segment 85 and a hinge segment 87. The hinge segment 87 of a given arm 80 are designed to fit at least partially within the arm-retaining portion 18 of an end 14 of clip 10. Furthermore, as with hinge elements 22 and middle segments 26 of arms 20, the hinge elements 82 of each arm 80 are longer than the middle segment 86 of each arm. This is illustrated in FIG. 16 by hinge element 82 having a length 82L that is greater than the length 86L of middle segment 86.

Figure 50:
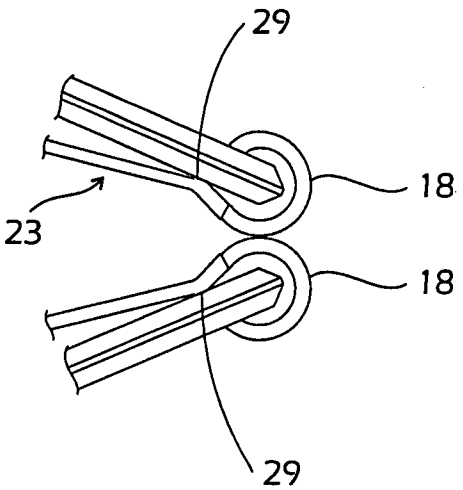
FIGS. 49–50 are top and detail views, respectively, showing a configuration of one embodiment of one of the present clips and the present arms configured such that the arms contact the clip early in the opening process for increased leverage, in contrast to the manner in which traditional binder clips work.
Figure 49:
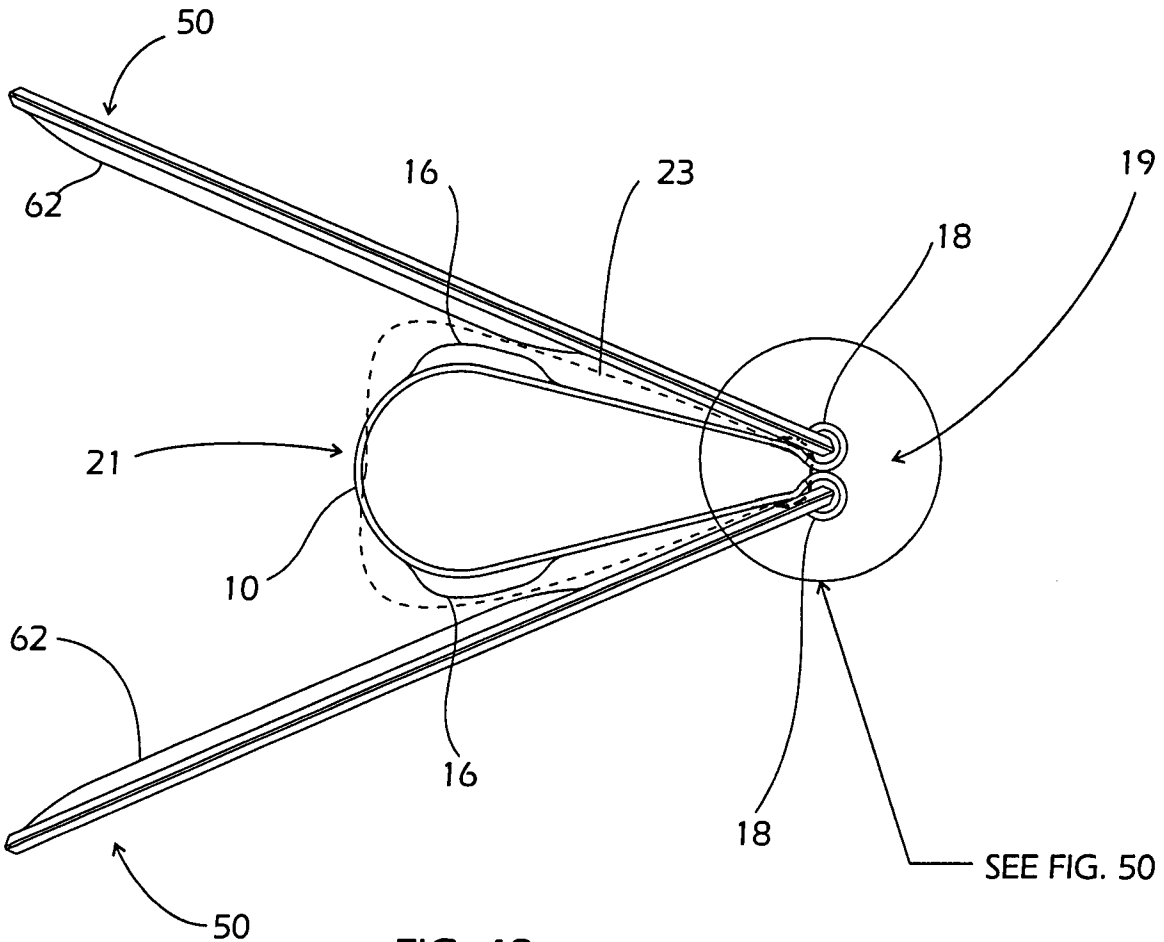
Figure 52:
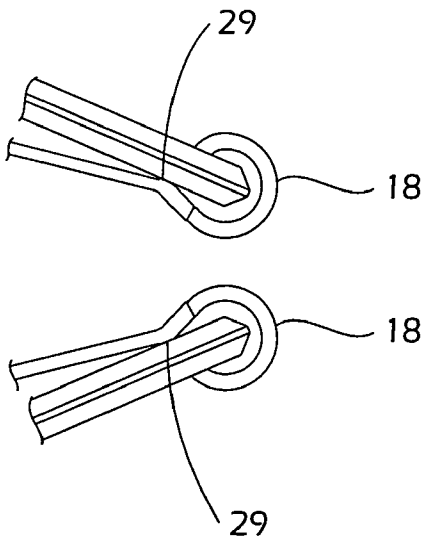
FIGS. 51–52 are top and detail views, respectively, showing the embodiment of device depicted in FIGS. 49 and 50 is an open position resulting from the benefit of that increased leverage.
Figure 51:
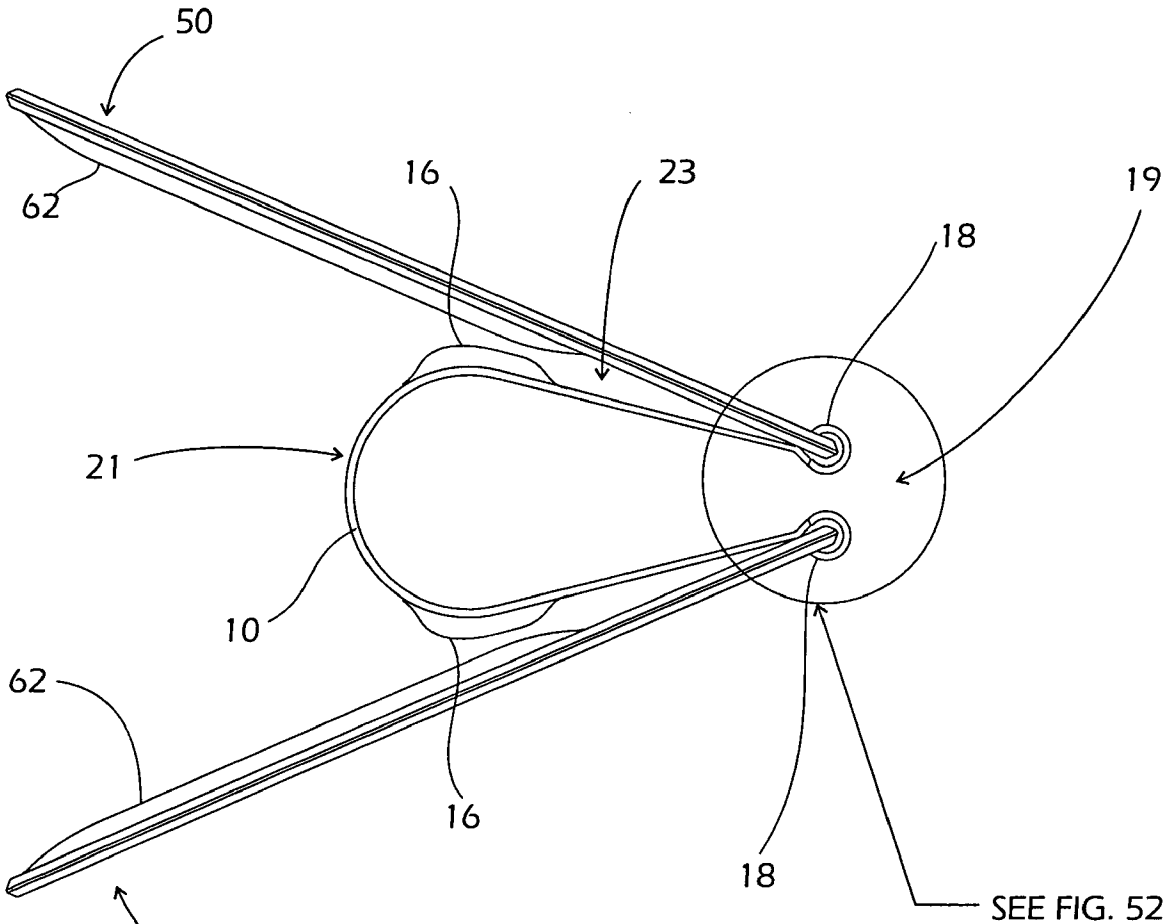
Figure 53:
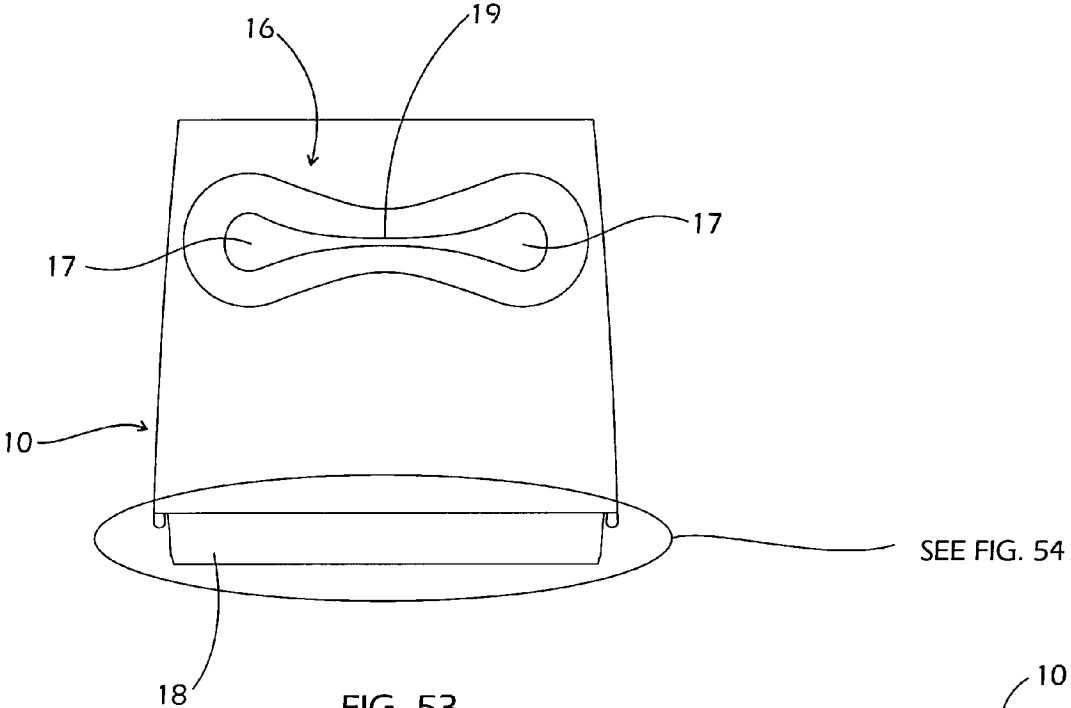
FIGS. 53–56 are side, end and detail views showing one embodiment of a suitable shape for certain of the present hinges, especially the shape of the portion of hinge that defines its outer open ends. Such shape furthers the likelihood that the arms that are coupled to such hinges will snap into place as they are closed.
Figure 54:
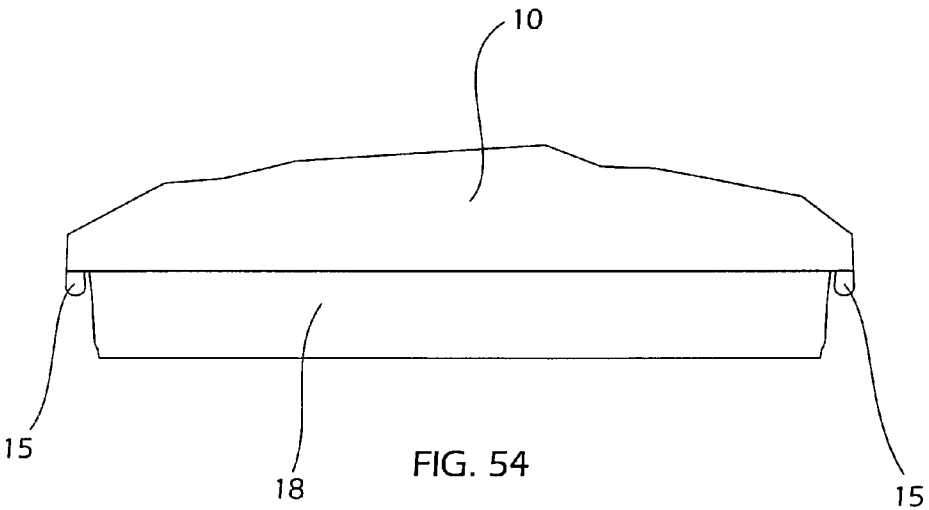
Figure 56:
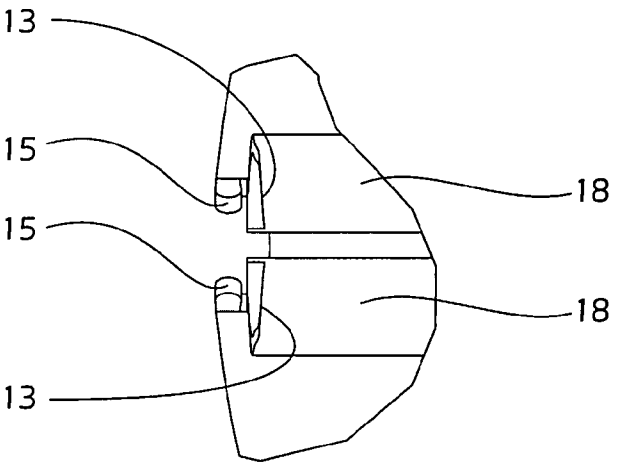
Figure 55:
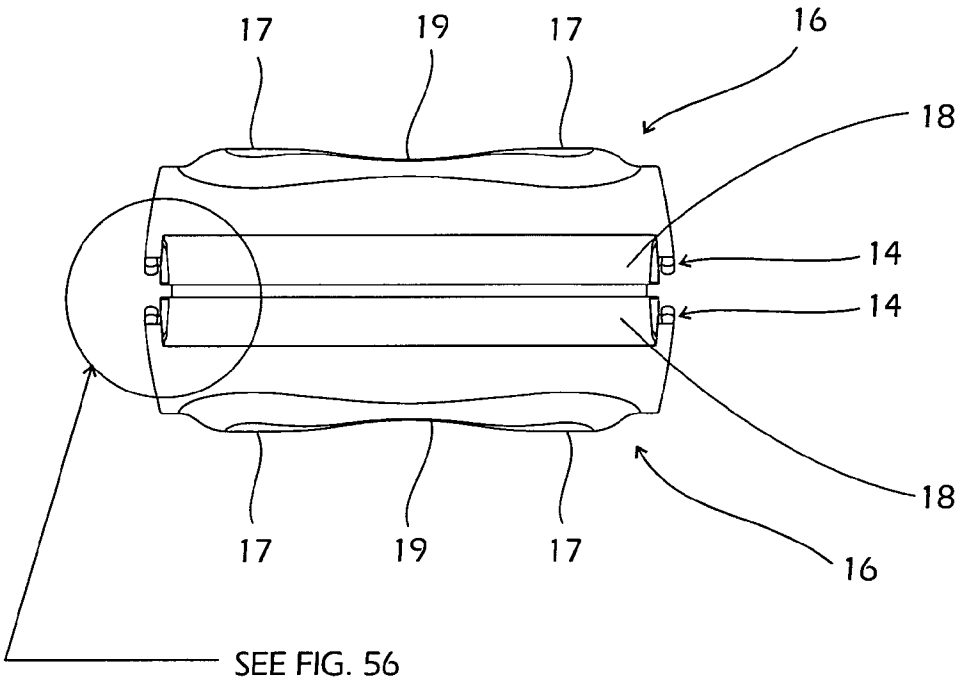

The clips and arms in certain embodiments of the devices shown in FIGS. 1–16 and 37–48 may be configured such that when force is applied to begin opening the clip of the device, one or both arms contact the clip at a location that is closer to the hinges of the clip than to the arch of the retaining portion RP, and the clip will begin to open before any contact between that arm and the clip at a second location that is closer to the arch than the hinges. An example of such a configuration is illustrated in FIGS. 49–52. FIG. 49 shows that clip 10 of device 100 (unlabeled) may have a main portion 23 that excludes the hinges 18 and the very back end of the tip of the arch. The device is in a bent-back position in this figure. FIG. 50 is an enlarged view of the detail circled in FIG. 49, and shows that contact between arm 50 and clip 10 (and, more specifically, main portion 23 of arm 50) occurs—during the process of applying force to begin opening clip 10—as locations 29, which are closer to the end 19 of the clip that is characterized by hinges 18 than to the end 21 of the clip that is characterized by the arch. (A suitable length spanning ends 19 and 21 for one embodiment of clip 10 is 1.245 inches.) Locations 29 may be positioned on segment 15, or protrusion 15, of clip 10 shown in, for example, FIGS. 53–56. FIG. 51 shows that as someone or something continues to apply that force, clip 10 will begin, and begins, to open before any contact between either arm and main portion 23 of clip 10 occurs at a second location (e.g., leverage bump 16 of clip 10) that is closer to end 21 than end 19. FIG. 52 shows that opening in slightly greater detail.

To the same end of configuring the clip as just discussed, the hinges of the present clips may be configured as shown in the different views of FIGS. 53–56. The edges 13 of the hinges 18 that define the outer open ends of those hinges may be shaped as shown in these figures.

There are many suitable ways of constructing the present devices, and there are many suitable materials that may be used. One material that may be used for the clip or spring of the devices shown in FIGS. 1–16 is carbon steel (e.g., medium carbon steel), or spring steel. The arms of these devices may also be made from such material. To create the clip using spring steel, a flat piece that has the shape of the clip laid flat may be cut using a die and punch method (e.g., stamped at room temperature). Any leverage bumps that are used on that clip may then be pressed into the cut clip using, for example, a die. The hinges of the clip may then be formed such that, in some embodiments, material is wrapped to form the hinges. Afterwards, the flat piece of spring steel may be bent to the desired configuration and tempered. The tempering may involve heating the material to 1525 to 1575 degrees F. (Fahrenheit) for a suitable period of time; quenching the material to 350 to 400 degrees F.; and tempering the material to 700 to 800 degrees F. for a suitable period of time. This heating and quenching may result in an Rc50 hardness. If the arms are made from spring steel, they may be cut using a die and punch method (e.g., stamped at room temperature) from spring steel that has been tempered. Alternatively, the spring steel need not have been tempered. In either case, any indentions may then be formed using, for example, a die. Any bow, such as a 1-, 2-, or 3-degree bow, that is given to the arms may then be formed using, for example, a die; and the heat treatment described above for the clip may be used on the arms. Sharp edges may be debugged after the stamping process described above. The debugged material may then be polished using any suitable polishing agent. Furthermore, electroplating and laser engraving may be used as desired to create a more attractive products. A brass electroplating may be applied to the clip and/or the arms, followed by one of a chrome, black nickel and silver electroplating. If chrome electroplating is used, a titanium electroplating may be applied over it. In any case, a clear E coating may be applied over whatever electroplating is carried out. The arms may then be pivotally coupled (e.g., hinged) to the hinges of the clip, and the resulting product may be packaged for sale.

Alternatively, the arms may be constructed from titanium, or any other metal or alloy that is stiff, not easily plastically-deformed, and that has good wear-resistant properties. It may also be possible to utilize certain polymers for the arms of the devices shown, for example, in FIGS. 1–16, provided the polymer possesses these same properties. Injection molding (using, for example, an extruder at some point in the process) may be used to create arms from polymers.

The remaining figures show other embodiments of the present devices. These embodiments include, generally, a clip, an outer element in contact with the clip, and arms pivotally coupled to the outer element. The clips in the remaining figures may also be described in this document (including the claims) as springs.

Referring generally now to FIGS. 17–27C, one embodiment of the present devices is device 400 shown in these figures. Device 400 includes a clip 410 that has an outer surface. Device 400 also includes an outer element 420 that contacts the outer surface of clip 410. Outer element 420 includes two ends 422. Device 410 includes an arm 430 pivotally coupled to each end 422. The arms 430 of device 400 may be provided with an indention 431 and an insert (not shown), in the same fashion as described above for the devices shown in FIGS. 1–16. Alternatively, no such indention may be provided (see FIG. 27A). The arms 430 of device 400 may be provided with a protrusion 428. Protrusions 428 are shown in FIGS. 17–27C as being centered across the width of arms 430. Protrusions 428 may be positioned so as to contact outer element 420 when clip 410 is opened.

Outer element 420 includes two sides 424, 426 that are hinged together. The hinging may be achieved by providing side 424 with a male element 495 (e.g., a "tongue") that has a passageway running through it (the passageway is unlabeled and may be cylindrical in shape); providing side 426 with two outer portions 497 that define between them a female portion 499 (e.g., a "groove"), the outer portions 497 each having a passageway running through them (the passageways are unlabeled and may be cylindrical in shape); and joining the outer portions 497 with the male portion 495 using a pin 440, as shown schematically in FIG. 25.

Sides 424 and 426 each include an outer surface 450 that has a recessed portion 452. Protrusions 428 of arms 430 of device 400 may be positioned so as to contact recessed portions 452 when clip 410 is opened.

Figure 25:
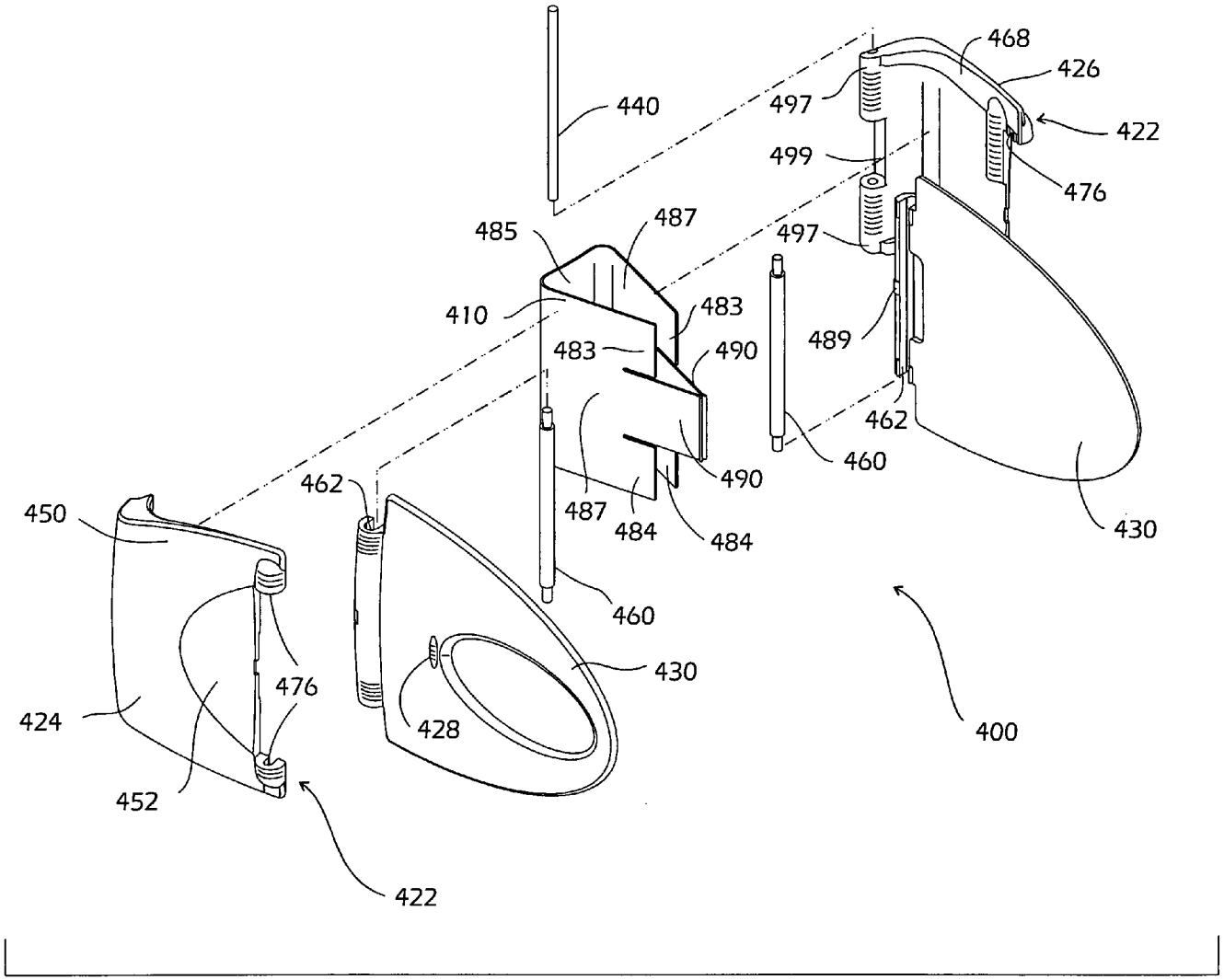
FIG. 25 is an exploded view of the elements of the device shown in FIG. 17, viewed in perspective.
Figure 26:
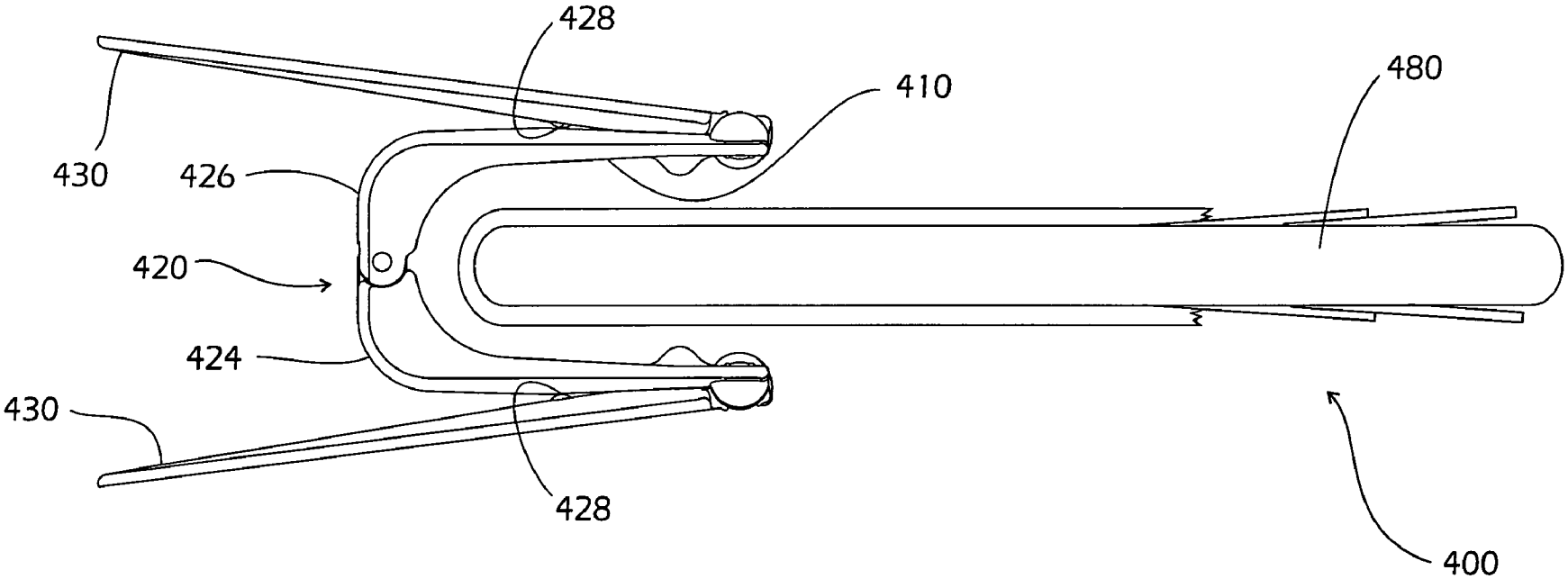
FIG. 26 is a top view of the device shown in FIG. 17, depicting that device in an opened position around a wallet.

Arms 430 are shown in FIGS. 17–27C as being coupled to ends 422 with pins 460 (see, especially, FIG. 25). One manner of achieving this pivotal coupling involves providing each arm 430 with a coupling portion 462 (shaped, for example, like a portion of a cylinder) that contacts the pin 460 that couples that arm to an end 422. Similarly, the end 422 of each side 424 and 426 may be provided with coupling portions 476 that contact the pin 460 that couples a given arm to that end (see, e.g., FIGS. 23–25).

Figure 22:
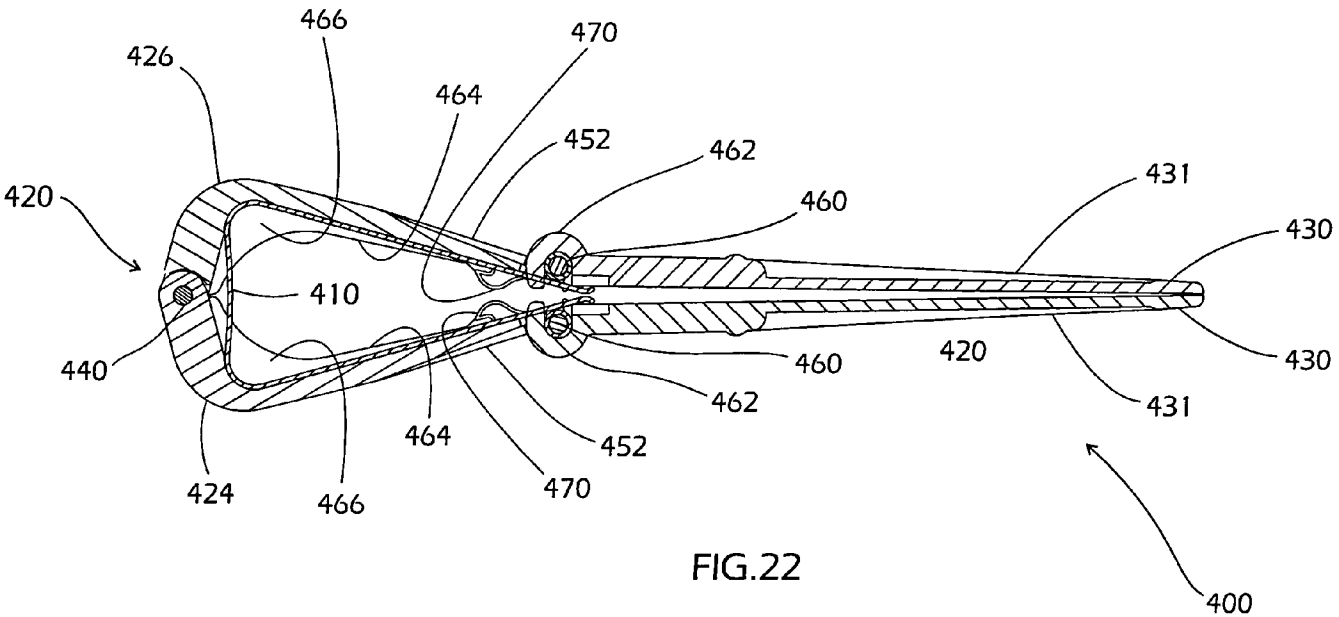
FIG. 22 is a cross sectional view of the device shown in FIG. 17, taken along cross-sectional line 18—18 shown in FIG. 18.
Figure 19:
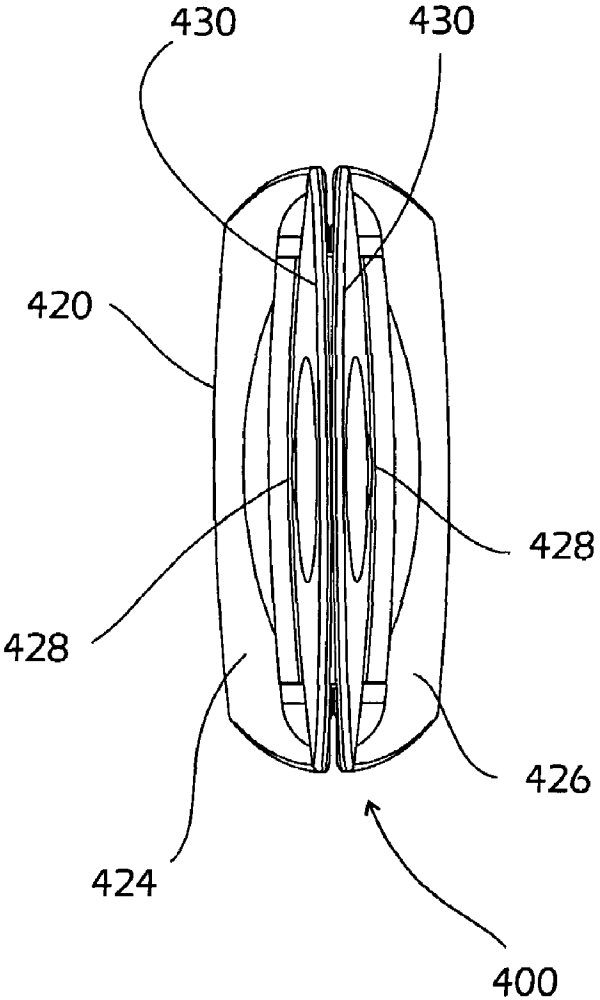
FIG. 19 is a front view of the device shown in FIG. 17.
Figure 20:
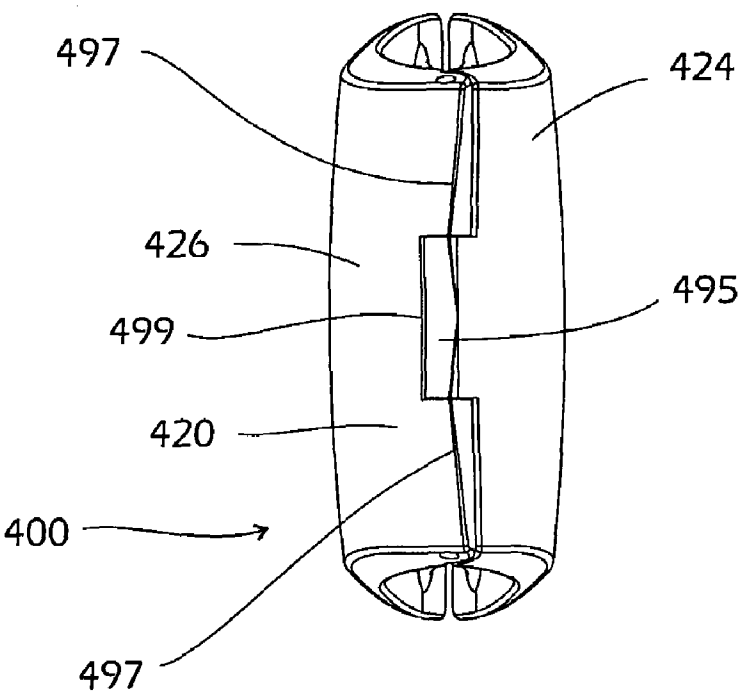
FIG. 20 is a back view of the device shown in FIG. 17.

Outer element 420 of device 400 includes an inner surface that includes a recessed portion, and clip 410 contacts the recessed portion of that inner surface. A version of this is shown in cross-sectional form in FIG. 22, where each side 424 and 426 includes an inner surface 464 with a recessed portion 466. Inner surfaces 464 of the two sides of element 420 comprise the inner surface of outer element 420. In addition, the recessed portions 466 of the two sides of outer element 420 comprise the recessed portion of the inner surface of outer element 420. Clip 410 is shown in FIG. 22 as being in contact with the recessed portion of the outer element (e.g., recessed portions 466 of the inner surfaces 464 of sides 424 and 426).

Figure 23:
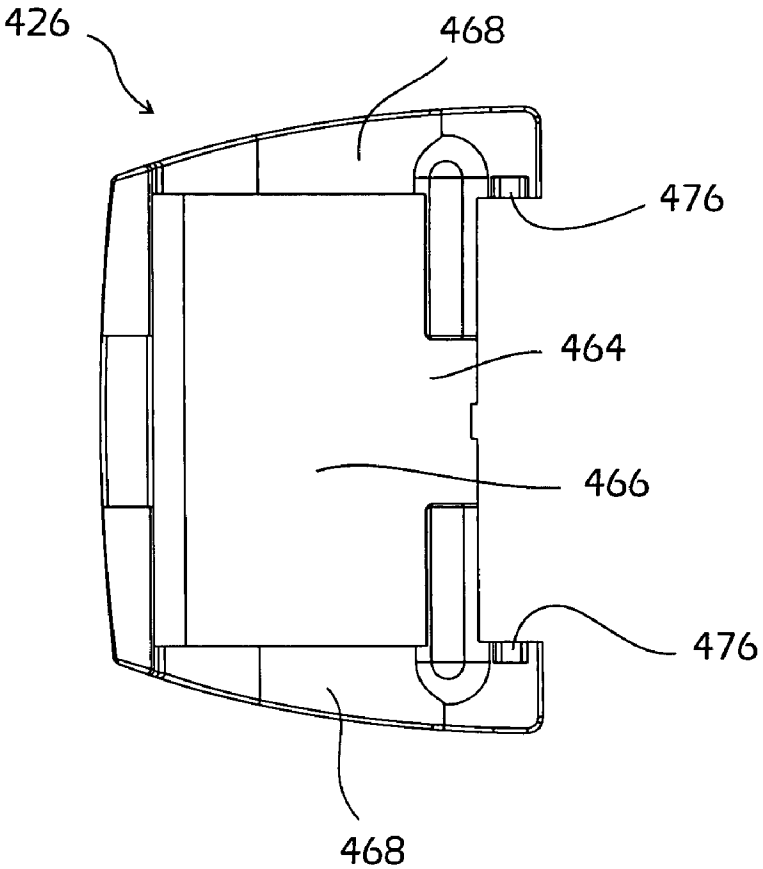
FIG. 23 is a view of the inter surface of one of the sides of the outer element of the device in FIG. 17.
Figure 24:
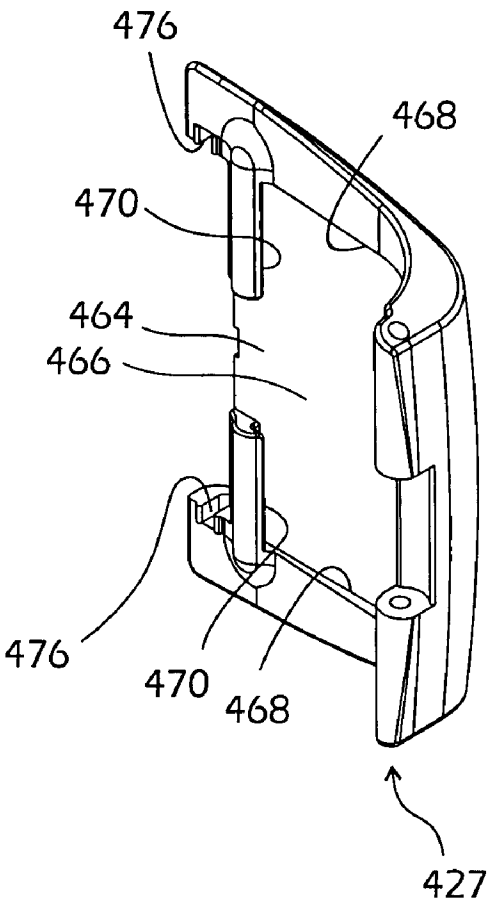
FIG. 24 is a perspective view of the side shown in FIG. 23.

FIG. 23 shows that the recessed portion 466 of inner surface 464 of side 426 (and this is also true of side 424) is bordered by two shoulder portions 468 (see also FIG. 25). Each shoulder portion 468 includes a groove 470 into which a portion of clip 410 fits. Grooves 470 are shown in FIGS. 22, 24, 27B and 27C. The manner in which portions of clip 410 fit within grooves 470 will be understood from considering FIGS. 25, 27B and 27C.

In FIG. 25, clip 410 as shown includes a back portion 485 and two retainer portions 487. Each retainer portion 487 includes an upper retainer element 483 and a lower retainer element 484. These two retainer elements are separated by a holding element 490. Holding element 490 extends farther from back portion 485 than either retainer element of either retainer portion. The upper and lower retaining elements 483 and 484, respectively, fit within grooves 470 as shown in FIGS. 27B and 27C. Holding elements 490 are slightly curved at their ends, as shown in FIG. 25. Holding elements 490 do not fit within and extend past grooves 470. The operation of holding elements 490 will be discussed more below.

Figure 27A:
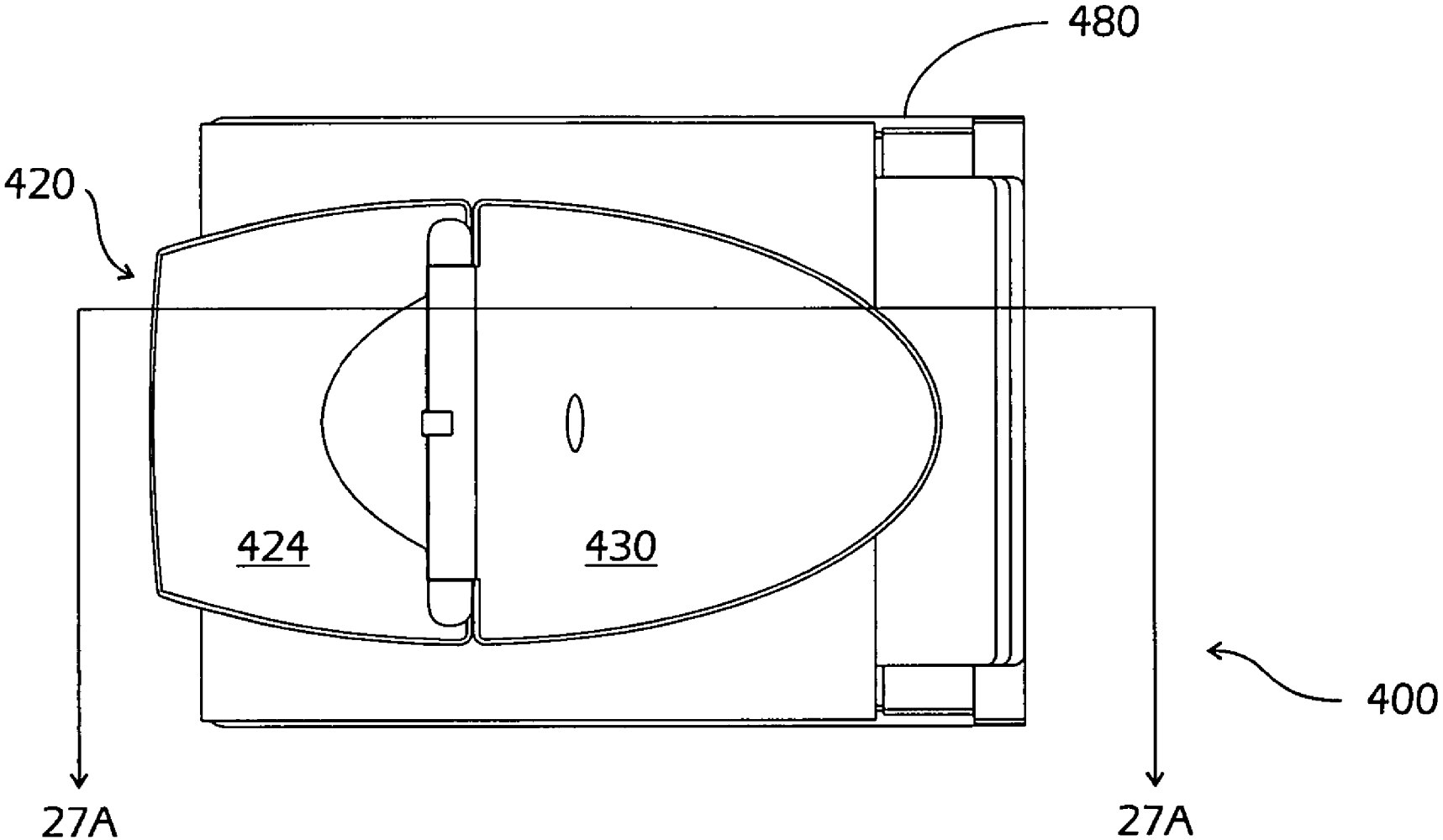
FIG. 27A is a side view of the device shown in FIG. 17 in a closed position around a wallet and lacking the indention shown in FIG. 17.
Figure 27B:
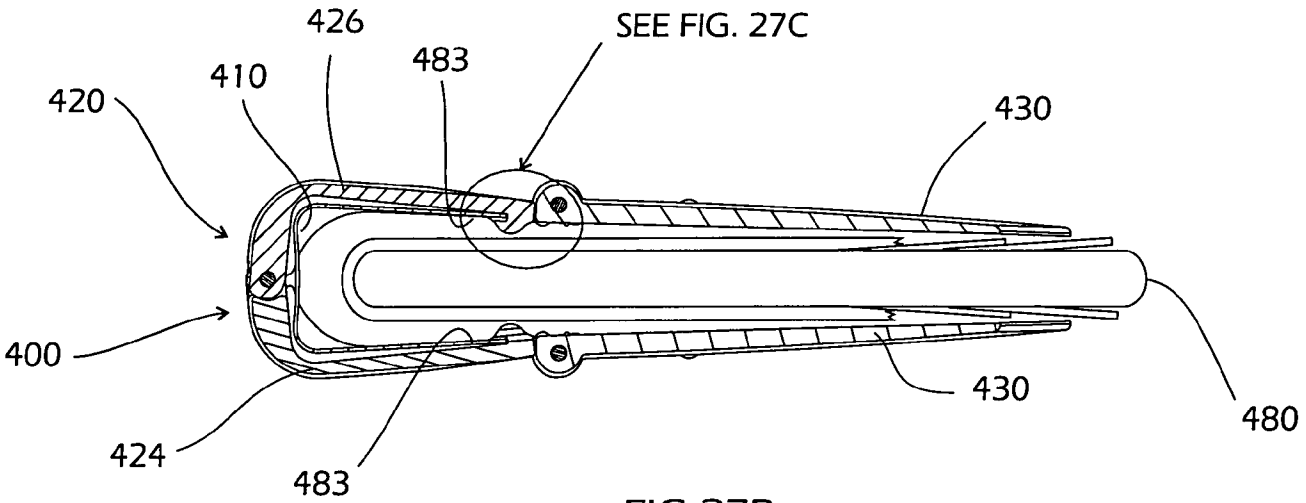
FIG. 27B is a cross-sectional view of the device depicted in FIG. 27A, taken along cross-sectional line 27A—27A in FIG. 27A.
Figure 27C:
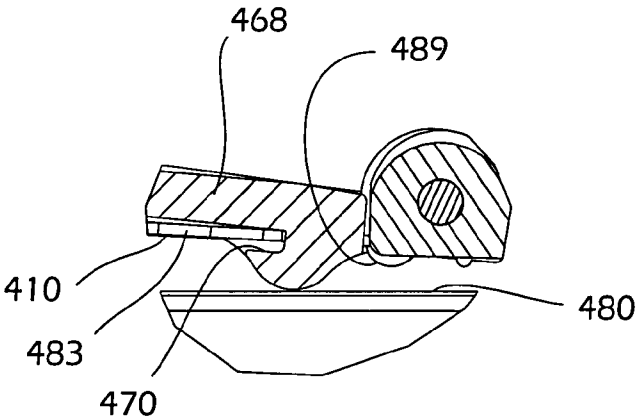
FIG. 27C is a view of the detail circled in FIG. 27B.

FIG. 27A shows that a wallet 480 holding cards and around which paper has been folded may be placed within device 400. Device 400 may be said to include wallet 480. Wallet 480 may be sized, or configured, to be held by clip 410. The portions of clip 410 that will perform most, if not all, of the "holding" function are the portions of shoulder portions 468 that form grooves 470. The surface of those portions may be rounded and smooth, as shown in the figures, so as not to damage the wallet or any paper wrapped around the wallet.

Figure 28A:
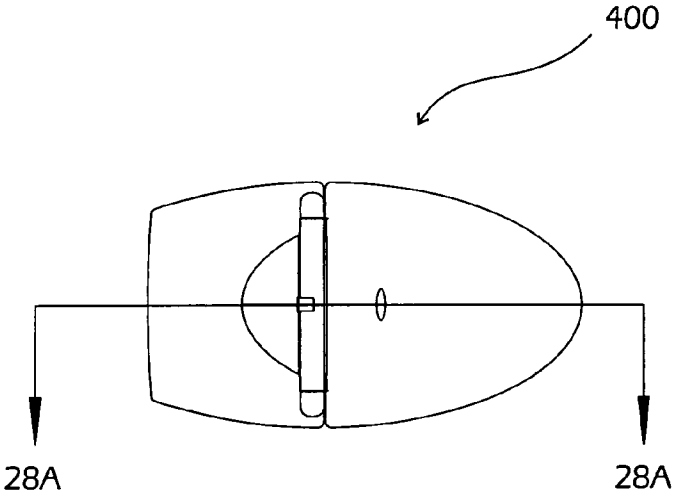
FIGS. 28A–28O include a series of side, cross-sectional and detail views showing different positions of the arms of the device shown in FIG. 17 relative to holding elements of the clip of that device. Specifically.
Figure 28B:
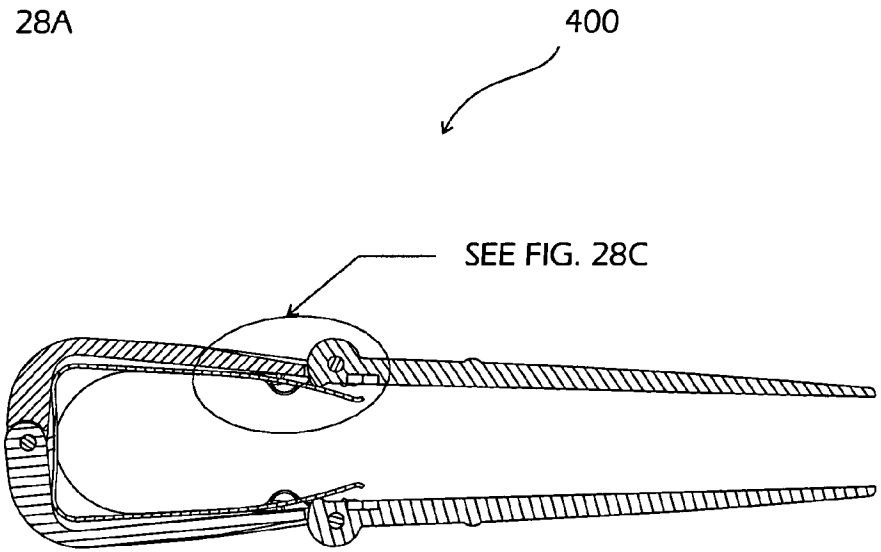
FIG. 28B is a cross-sectional view taken along cross-sectional line 28A—28A in FIG. 28A.
Figure 28C:
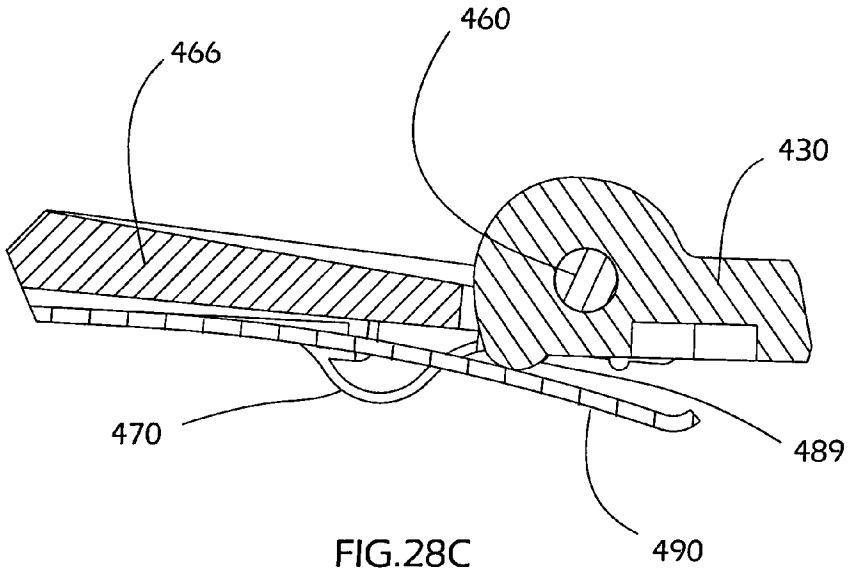
FIG. 28C is a view of the detail circled in FIG. 28B.
Figure 28F:
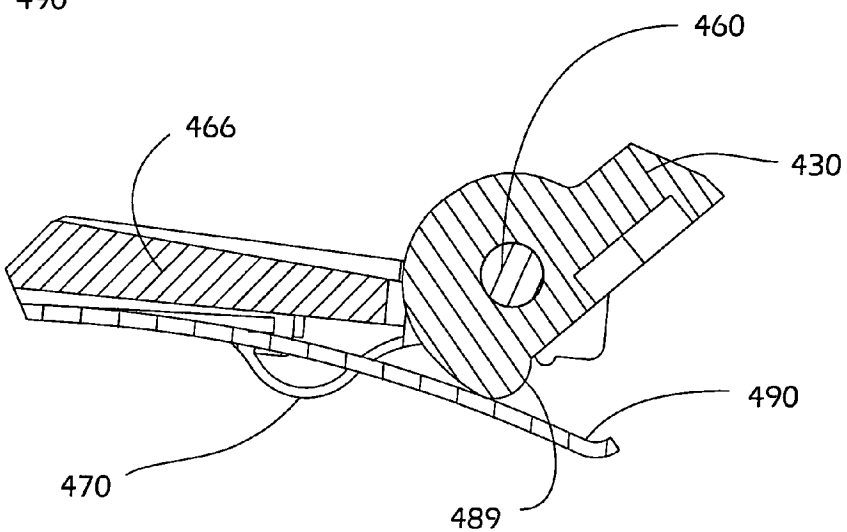
FIG. 28F is a view of the detail circled in FIG. 28E.
Figure 28E:
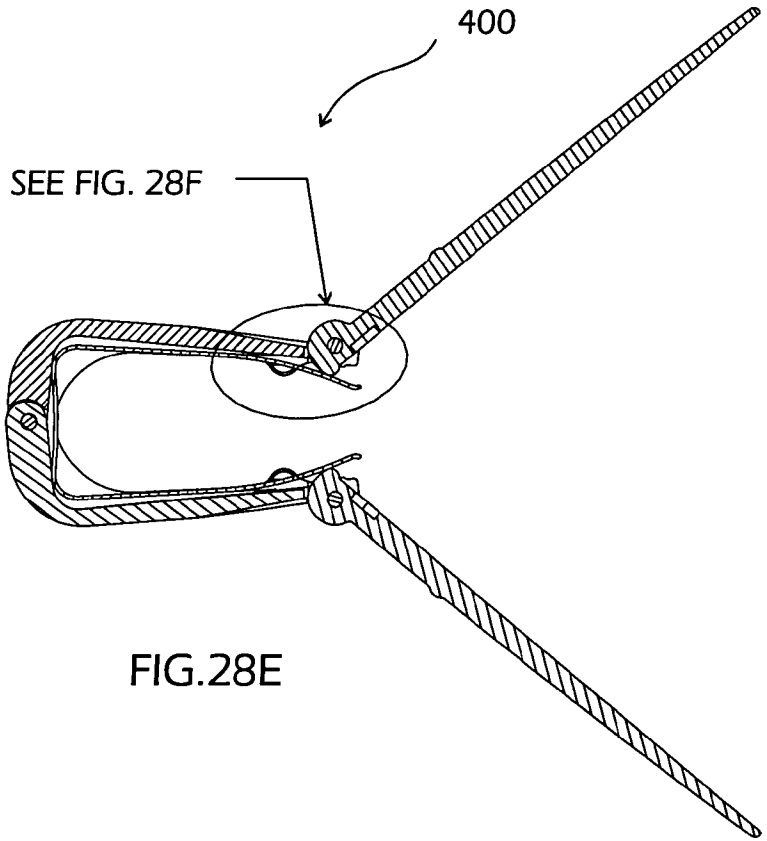
FIG. 28E is a cross-sectional view taken along cross-sectional line 28D—28D in FIG. 28D.
Figure 28D:
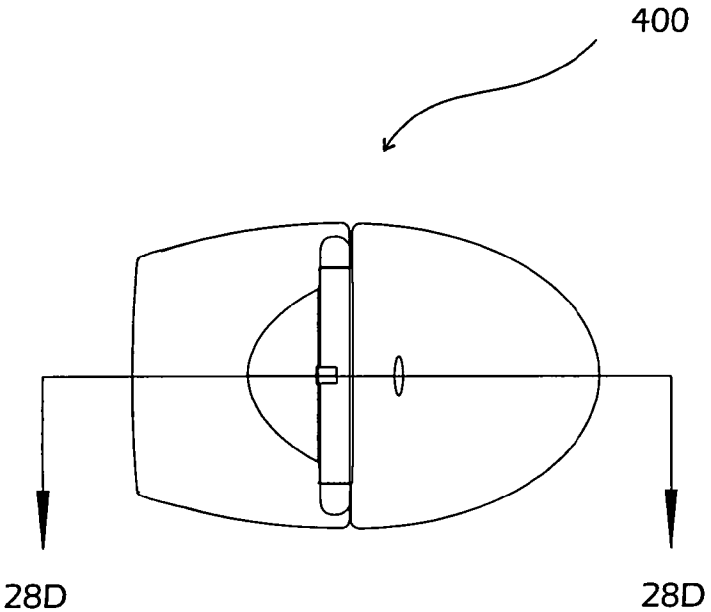
FIG. 28H is a cross-sectional view taken along cross-sectional line 28G—28G in FIG. 28G.
FIG. 28I is a view of the detail circled in FIG. 28H.
FIG. 28K is a cross-sectional view taken along cross-sectional line 28J—28J in FIG. 28J.
FIG. 28L is a view of the detail circled in FIG. 28K.
FIG. 28N is a cross-sectional view taken along cross-sectional line 28M-28 in FIG. 28M.
Figure 28H:
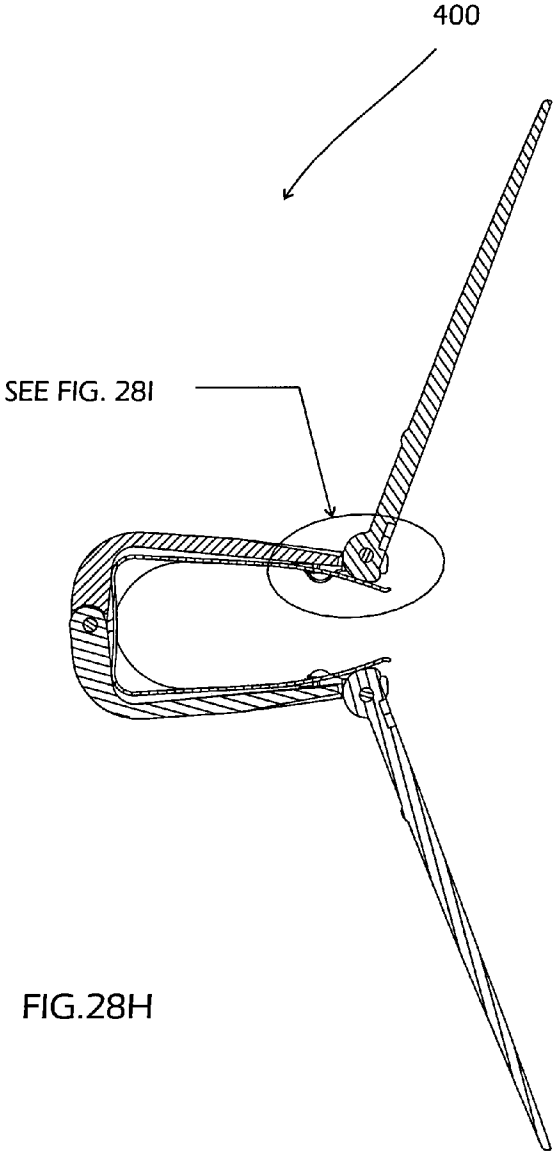
Figure 28G:
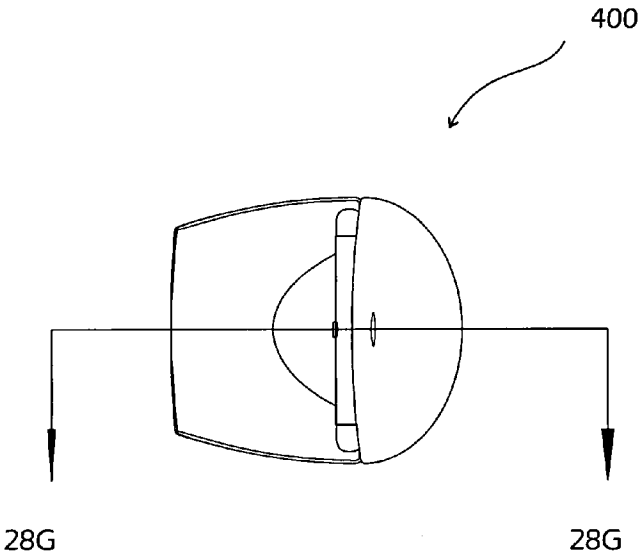
Figure 28I:
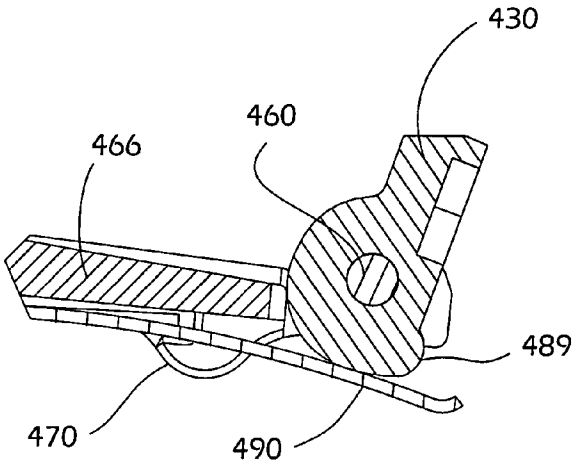
Figure 28L:
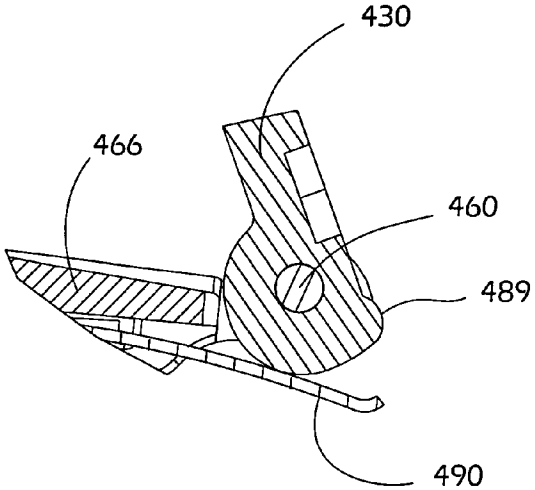
Figure 28O:
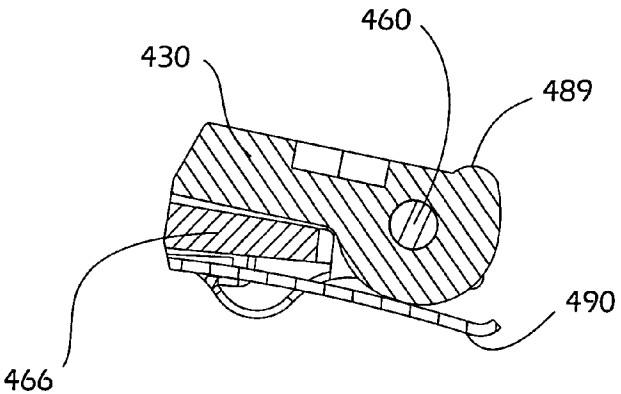
Figure 28K:
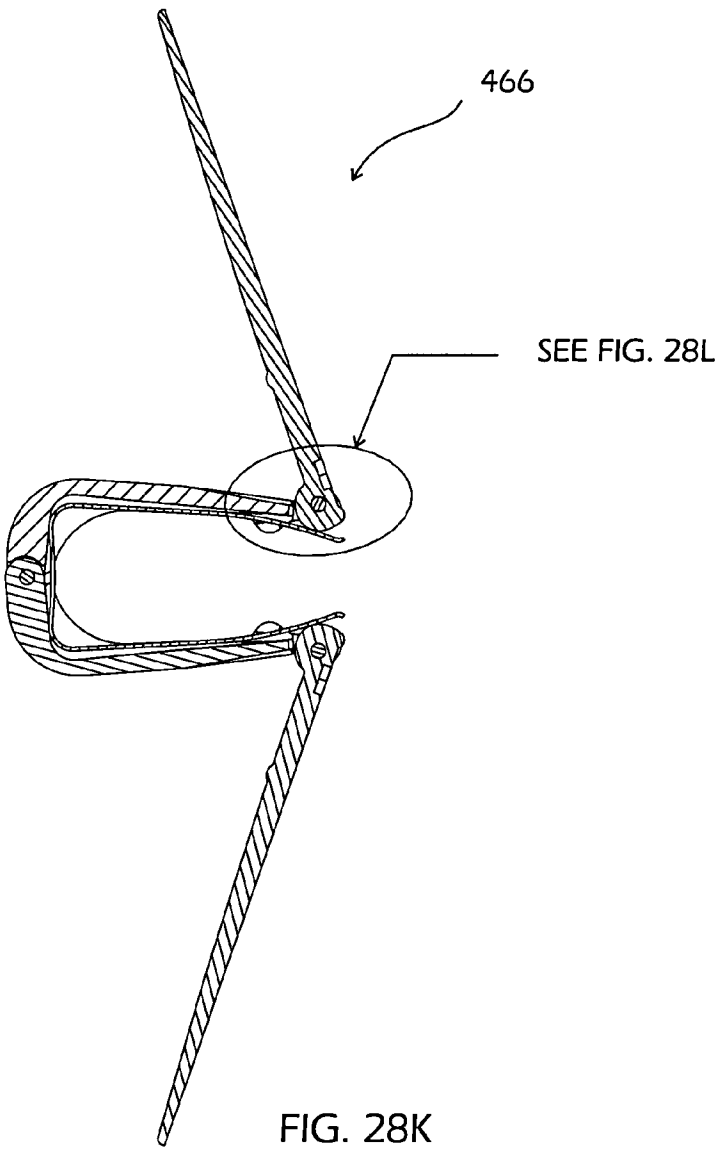
Figure 28J:
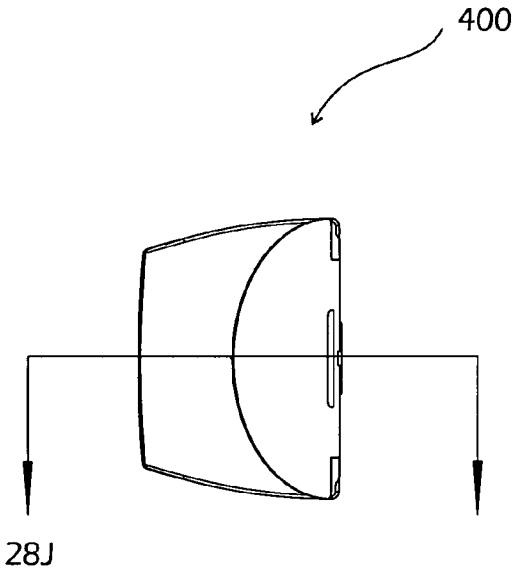
Figure 28N:
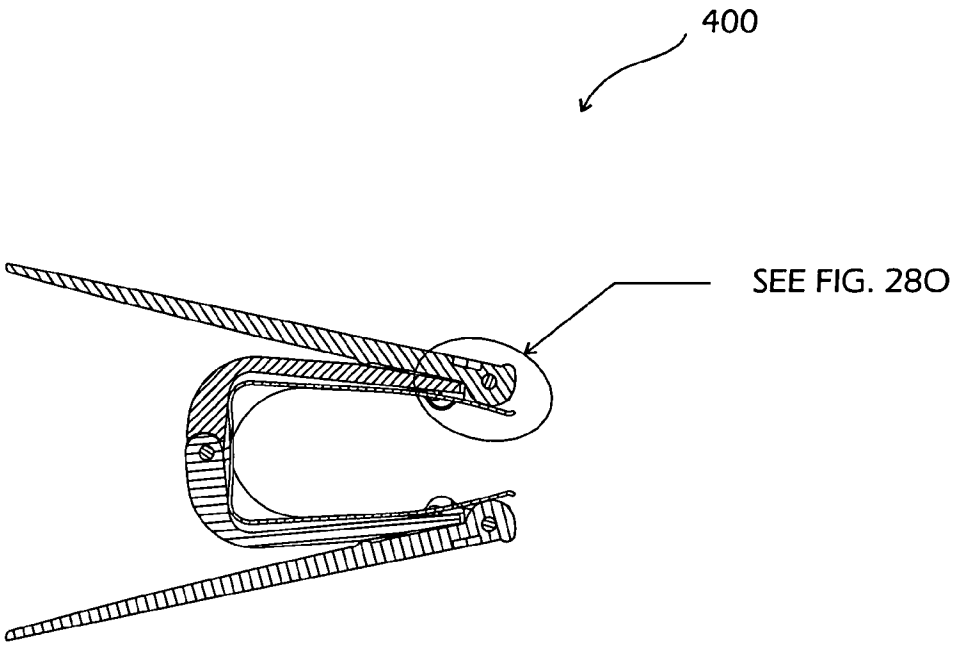
Figure 28M:
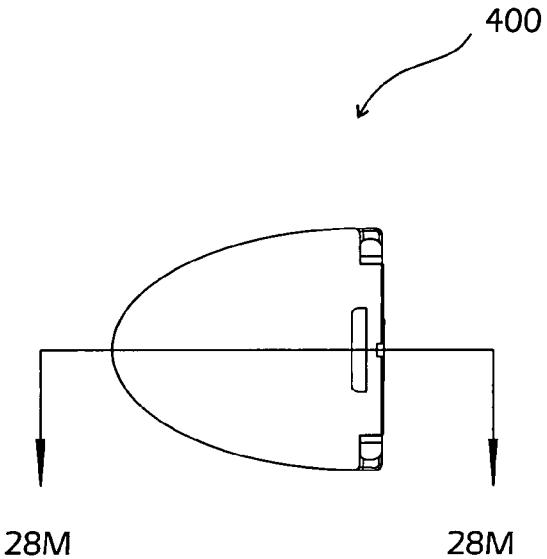
Figure 29:
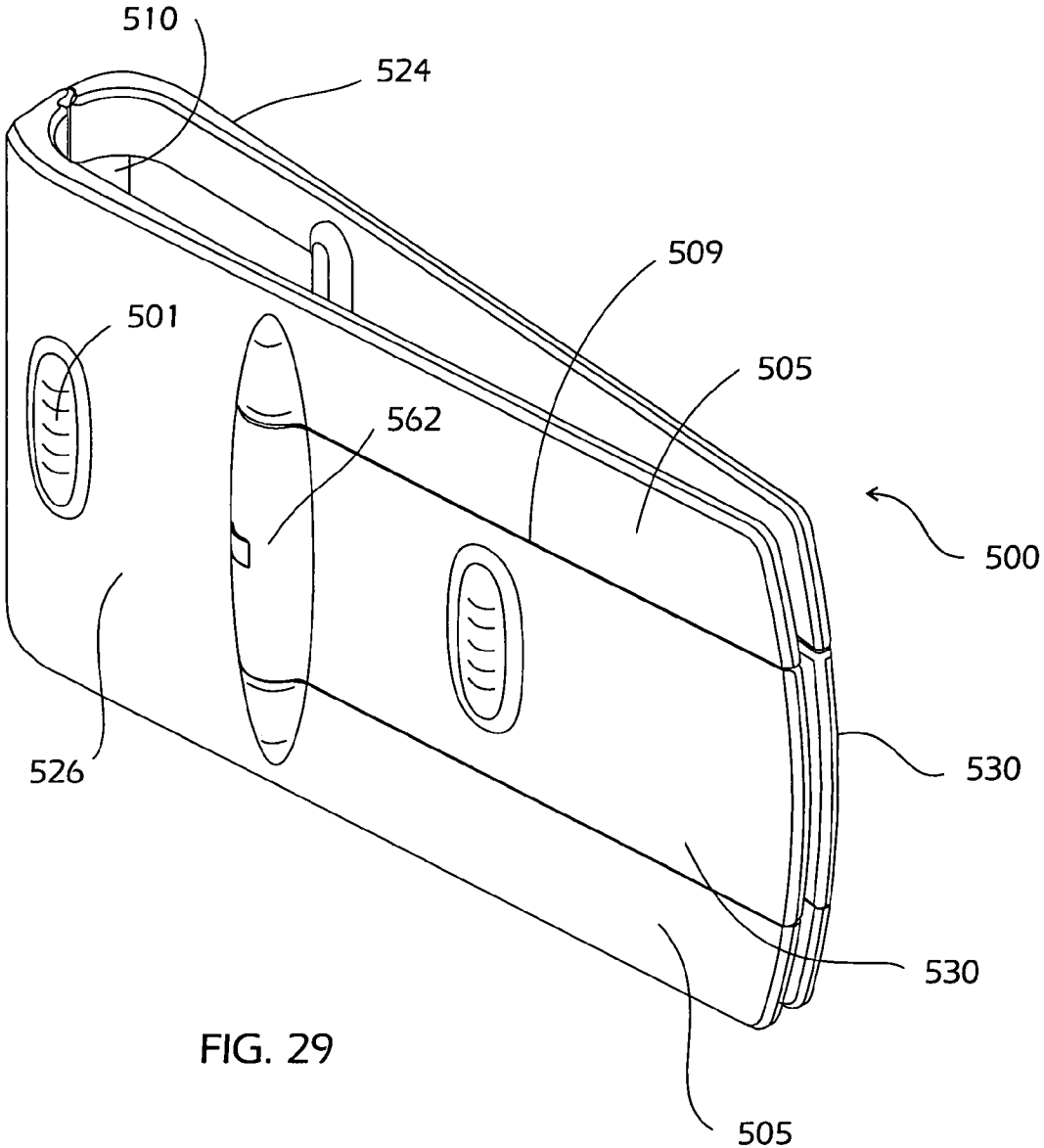
FIG. 29 is a perspective view of another of the present devices.
Figure 33:
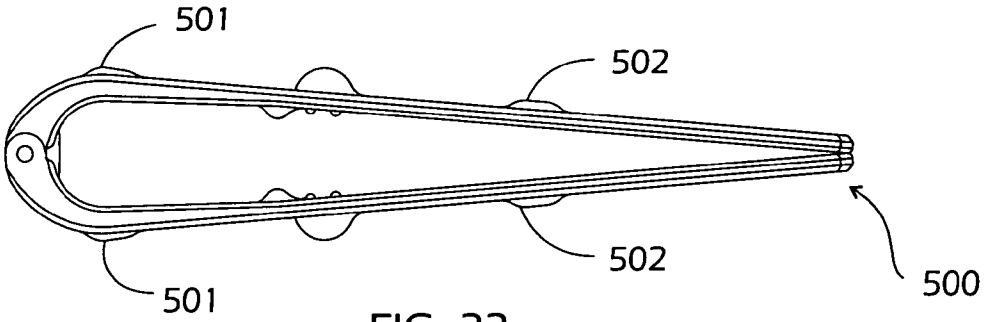
FIG. 33 is a top view of the device depicted in FIG. 29.
Figure 30:
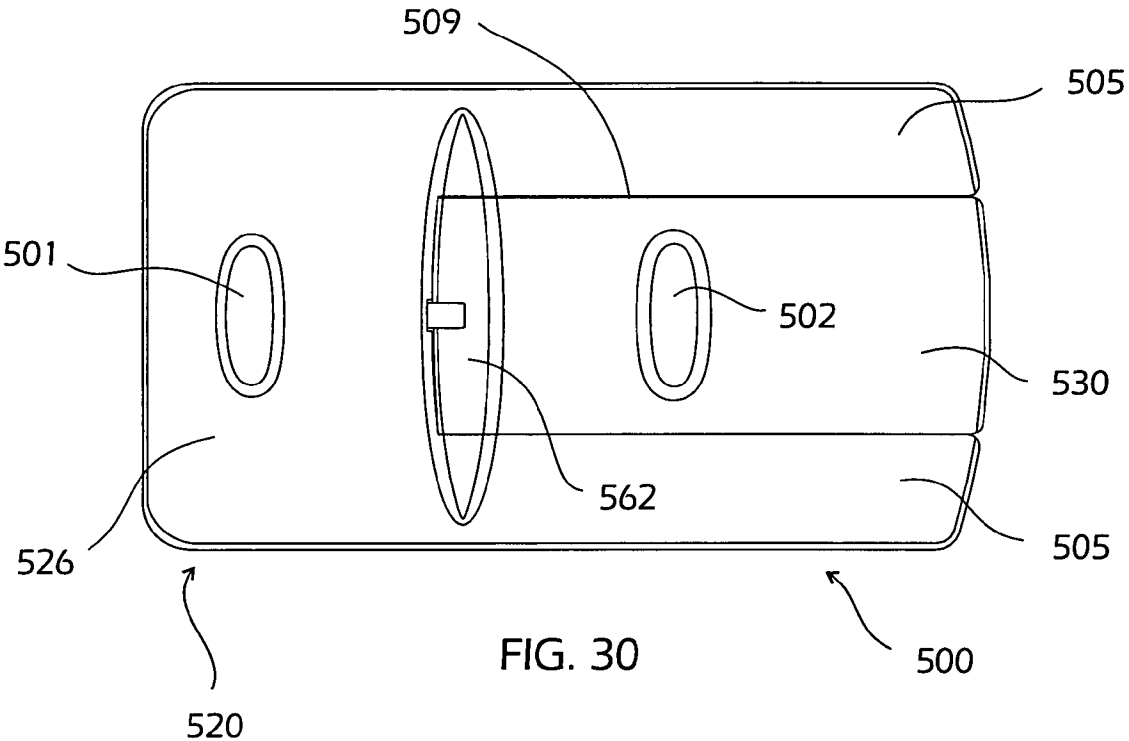
FIG. 30 is a side view of the device depicted in FIG. 29.
Figure 31:
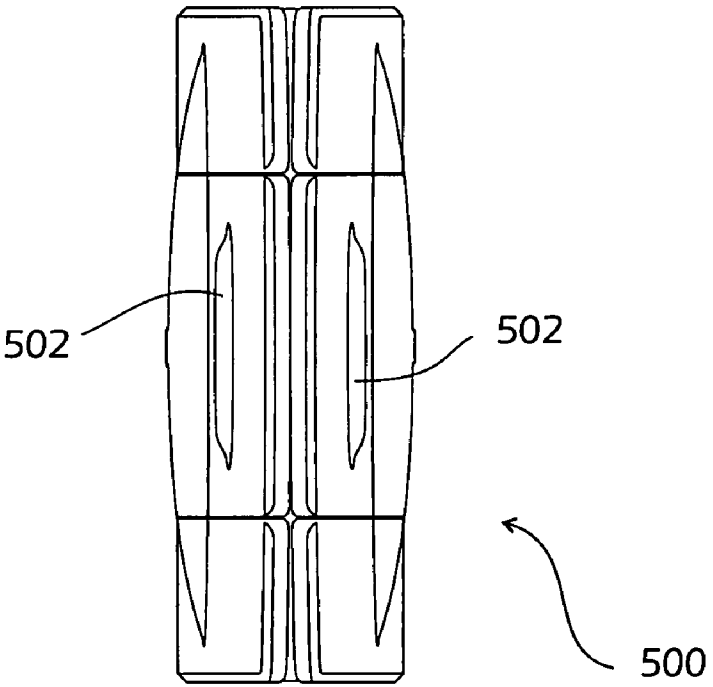
FIG. 31 is a front view of the device depicted in FIG. 29.
Figure 32:
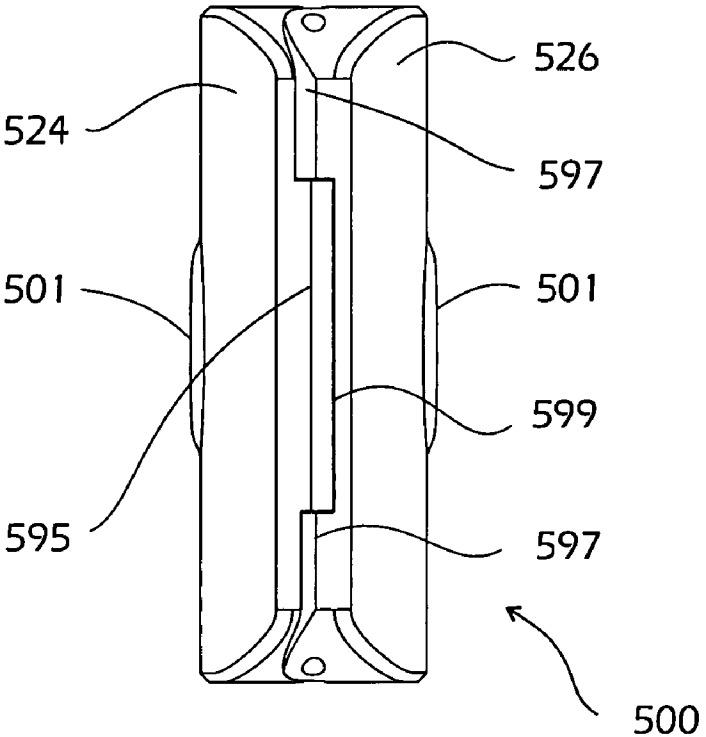
FIG. 32 is a back view of the device depicted in FIG. 29.
Figure 34:
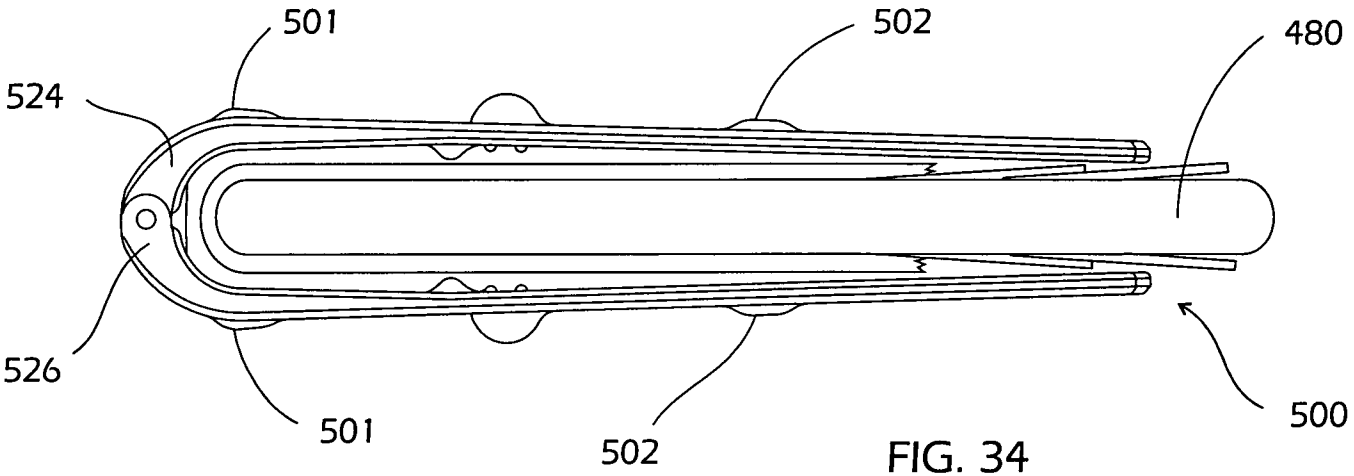
FIG. 34 is a top view of the device depicted in FIG. 29, showing that the device may include a wallet.

Holding elements 490 may provide some or none of the "holding" function. Holding elements 490 primarily function to prevent unwanted movement of arms 430. In this regard, coupling portions 462 of arms 430 may be provided with one or more cam bumps 489 (see FIGS. 25 and 27C). FIGS. 28A–28O are a series of views that show how holding elements 490 operates in the embodiment shown to keep pressure on arms 430, in part, through contact with cam bumps 489. These figures (along with FIGS. 27B and 27C) also show that the coupling portion of the arms of may be "closed," instead of half-open, as shown, for example, in FIG. 25.

Figure 35:
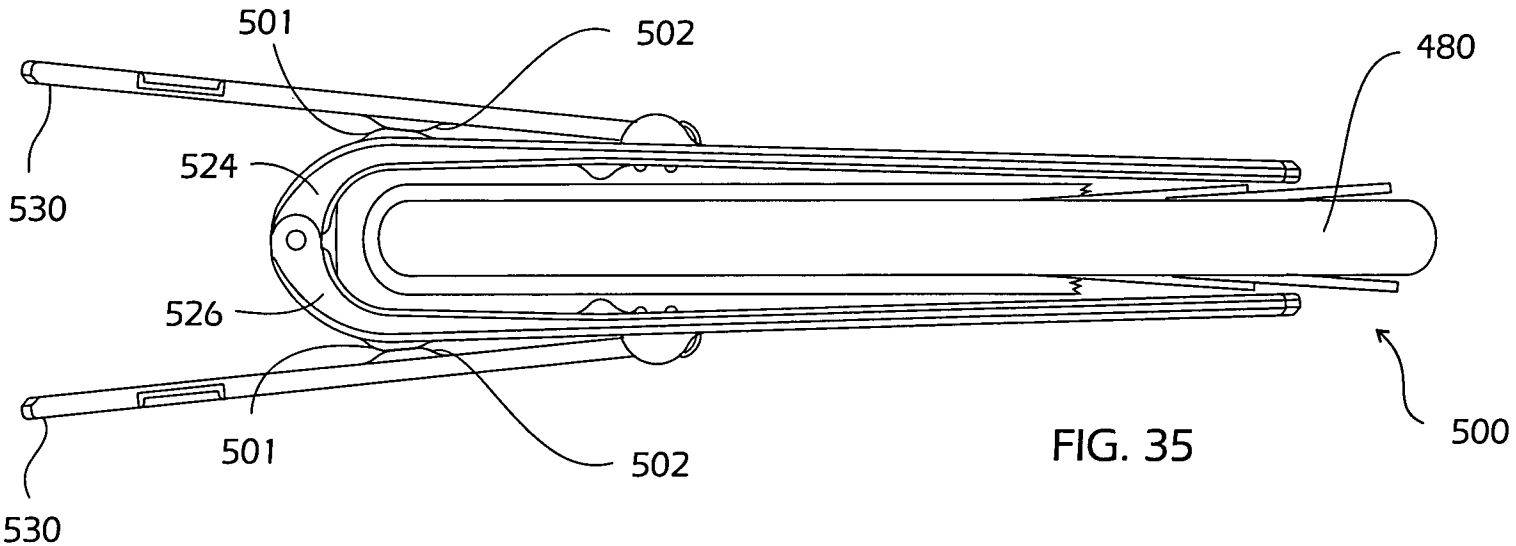
FIG. 35 is a top view showing the arms of the device depicted in FIG. 29 folded back.
Figure 36:
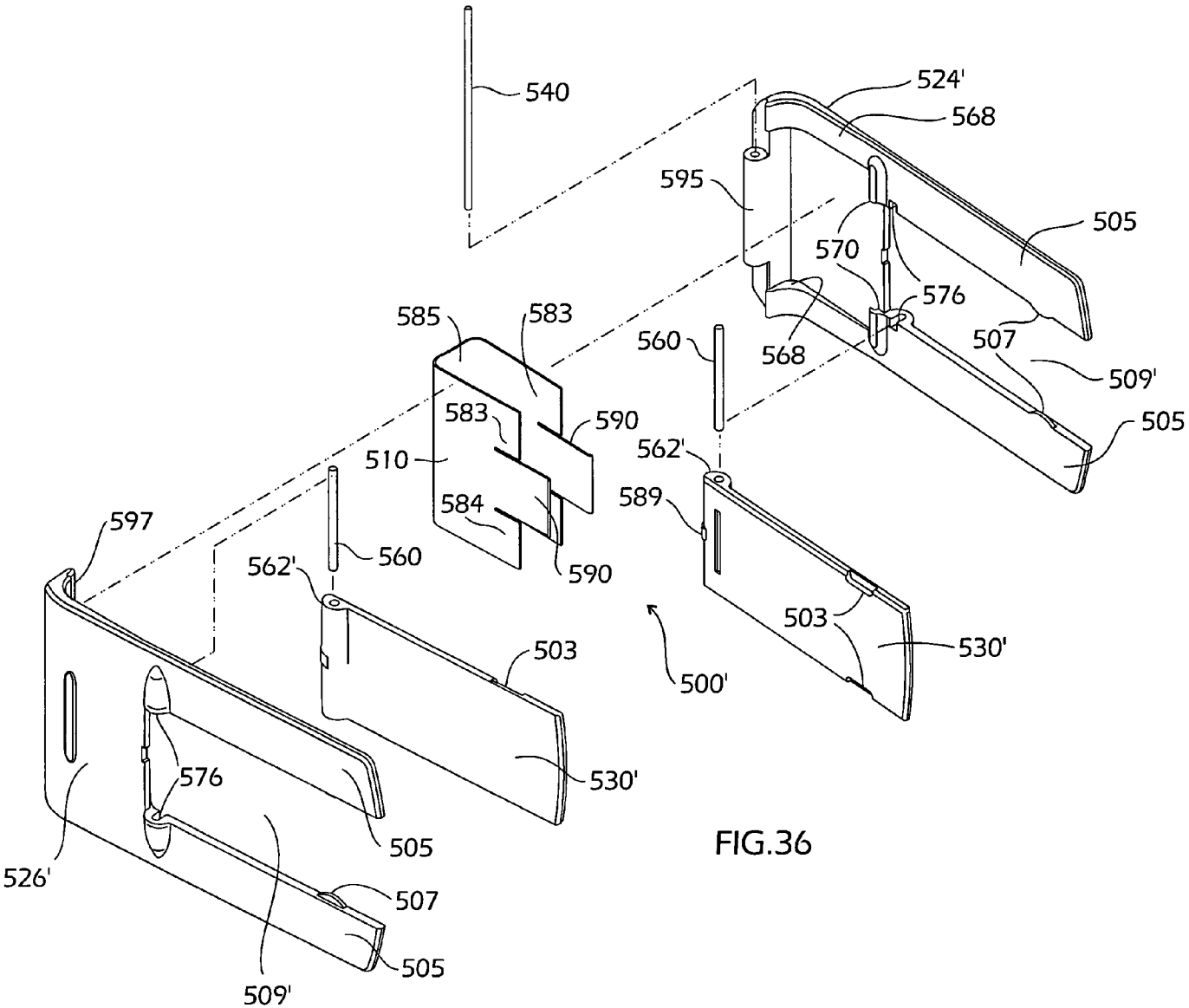
FIG. 36 is an exploded view of the elements of another version of the device depicted in FIG. 29.
Figure 43:
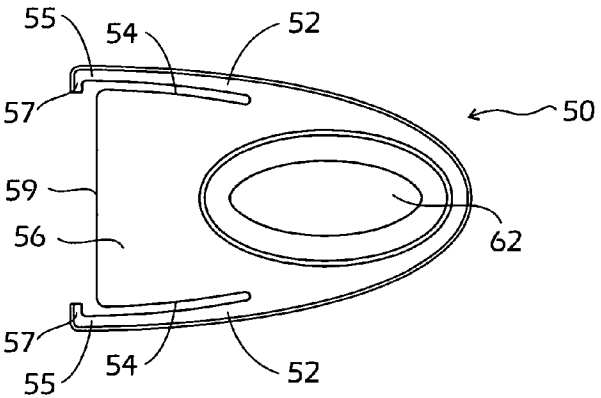
FIGS. 43–48 are inside (side), outside (side), end, top, outside perspective, and inside perspective views, respectively, of another version of one of the present arms that has an outwardly protruding indention.
Figure 44:
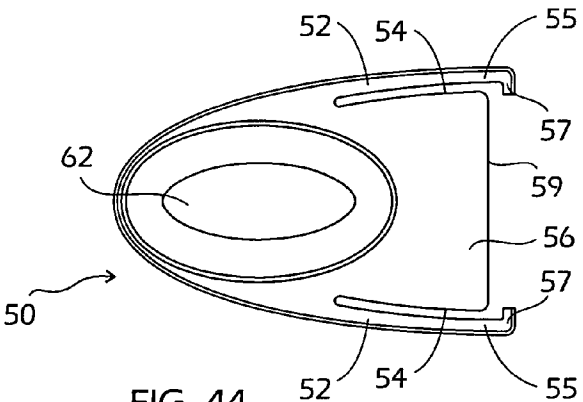
Figure 45:
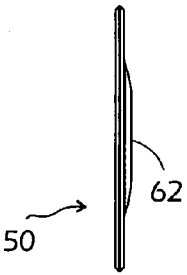
Figure 46:
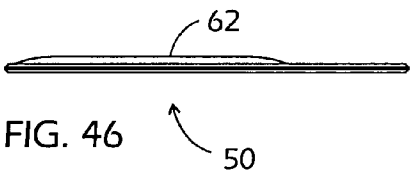
Figure 47:
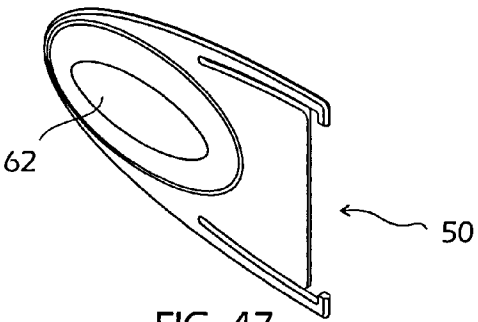
Figure 48:
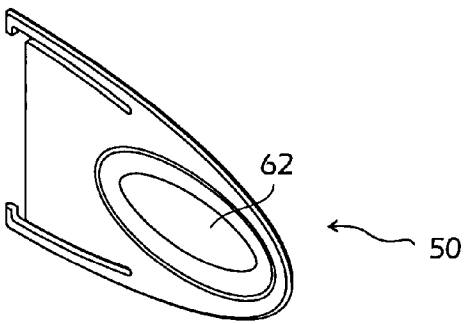

FIGS. 29–36 show another of the present devices that includes a clip, an outer element in contact with the clip, and arms pivotally coupled to the outer element. There are a number of similarities between the devices shown in FIGS. 29–36 and the devices shown in FIGS. 17–28O. Accordingly, elements of the devices in FIGS. 29–36 that are similar to certain elements of the devices in FIGS. 17–28O have been given similar element numbers, except that the element numbers have been increased by 100. Likewise, the only difference between the device depicted in FIGS. 29–35 and the device depicted in FIG. 36 are certain details of the arms and sides of those devices. As a result, where the sides and arms of the device depicted in FIGS. 29–35 have been labeled 526, 524, and 530, respectively, those same elements have been labeled 526', 524', and 530' for the device depicted in FIG. 36. The shape of the coupling portions 562 of arms 530 of FIG. 500 shown in FIGS. 29–35 are also slightly different in shape than those same features in device 500' in FIG. 36. Accordingly, the coupling portion of arms 530' have been labeled with element number 562'.

Unlike the device shown in FIGS. 17–28O, device 500 in FIGS. 29–35 includes leverage bumps on at least one side of outer element 520. More specifically, outer element 520 of device 500 includes leverage bumps 501 on both sides 526 and 524. At least one arm 530 of device 500 includes a leverage bump 502. More specifically, both arms 530 of device 500 include leverage bumps 502. Each leverage bump 502 contacts outer element 520 when clip 510 is open. More specifically, each leverage bump 502 is configured to contact leverage bump 501 of the corresponding side of outer element 520 when clip 510 is opened. This contact is shown in FIG. 35 just prior to clip 510 being opened.

Sides 526 and 524 of device 500, and sides 526' and 524' of device 500', each have two elongated elements 505 that define between them an arm recess. This arm recess is labeled as 509 in FIGS. 29–35 and as element 509' in FIG. 36. The difference between the two arm recesses is the shape near the coupling portions 562 and 562' of the two devices.

Arms 530 and 530' of devices 500 and 500' may be provided with female notches 503 as shown in FIG. 36. Outer elements 505 of devices 500 and 500' may be provided with corresponding male notches 507 as shown in FIG. 36. If appropriately configured, the corresponding notches may better serve to keep arms 530 and 530', respectively, from bending more inwardly than elongated elements 505 when the devices are in the closed position.

The elements of the devices shown in FIGS. 17–36 may be made in a variety of ways. One way of making the clips of these devices is discussed above (i.e., using spring steel that is cut, bent, and then tempered). The outer elements and arms of the devices in these figures need not be as rigid as the arms of the devices in FIGS. 1–16 preferably are. For example, the outer elements (e.g., the sides of the outer elements) of the devices in FIGS. 17–36 may be made from cast aluminum, silver (e.g., sterling silver), gold (provided the carat value is not too high), magnesium, steel, titanium, or a hard polymer. The arms and out elements may be cast or injection molded using either a metal (or alloy) or a polymer.

All of the devices disclosed and claimed can be made and used without undue experimentation in light of the present disclosure. While the present devices have been described in terms of certain embodiments, it will be apparent to those of skill in the art that variations may be applied to these devices without departing from the scope of the present invention as defined by the following claims. For example, the arms of the present devices may be any suitable shape, including hexagonal, or octagonal, as may any indentions and inserts.

The claims are not to be interpreted as including means-plus- or step-plus- function limitations, unless such a limitation is explicitly recited in a given claim using the phrase (s) "means for" or "step for," respectively.

We claim:

1. A device comprising:

a clip having two ends and a leverage bump; and an arm pivotally coupled to each end;

where one of the arms contacts the leverage bump when the clip is opened, at least one of the arms is a non-wire frame arm, the leverage bump includes two outer portions and a middle portion, and the two outer portions protrude more outwardly from the clip than the middle portion.

2. A device comprising:

a clip having two ends and a leverage bump; and an arm pivotally coupled to each end;

where one of the arms contacts the leverage bump when the clip is opened, at least one of the arms is a non-wire frame arm, each arm includes two hinge elements separated by two slots and a middle segment, and each hinge element has an elongated segment and a hinge segment.

3. The device of claim 2, where each end of the clip includes an arm-retaining portion, and the hinge segments of a given arm fit at least partially within the arm-retaining portion of an end of the clip.

4. The device of claim 2, where the hinge elements of each arm are longer than the middle segment of that arm.

5. The device of claim 2, where an edge of the middle segment of each arm is positioned near the arm-retaining portion of an end of the clip.

6. A device comprising:

a clip having a receiving portion and a holding portion, the receiving portion being defined by a single arch, and the holding portion including two ends; and an arm pivotally coupled to each end, where each arm includes two hinge elements separated by two slots and a middle segment, and each hinge element has an elongated segment and a hinge segment.

7. The device of claim 6, where each end of the clip includes an arm-retaining portion, and the hinge segments of a given arm fit at least partially within the arm-retaining portion of an end of the clip.

8. A device comprising:

a clip having two hinges positioned beside each other, each hinge having two outer open ends; and an arm pivotally coupled to each hinge, each arm including two hinge segments that are positioned at least partially within the two outer open ends of each hinge, the hinge segments of at least one of the arms having hinge segment ends that face toward each other, one of the hinge segments having a non-circular cross-sectional profile;

the device being sized to hold one or more of paper, cards and a wallet.

9. The device of claim 8, the clip having a leverage bump positioned such that one of the arms contacts the leverage bump when the clip is opened.

10. The device of claim 9, each arm having an elongated segment extending from the hinge segment of that arm; and, when the clip is opened, an elongated segment of a given arm contacts the clip before the given arm contacts the leverage bump.

11. The device of claim 10, the elongated segments of a given arm being separated by two slots and a middle segment.

12. The device of claim 11, each arm having a hinge element that includes one of the elongated segments and one of the hinge segments, the hinge element of a given arm being longer than the middle segment of the given arm.

13. The device of claim 11, an edge of the middle segment of each arm being positioned near a hinge of the clip.

14. The device of claim 9, the clip having two leverage bumps, and each arm contacts a leverage bump when the clip is opened.

15. The device of claim 9, each arm having a widest portion and the clip having a widest portion, the widest portions of the arms and the clip having substantially the same width.

16. The device of claim 15, the widest portion of each arm being positioned near the widest portion of the clip.

17. The device of claim 9, each arm including an indention.

18. The device of claim 17, the indention of one of the arms protruding outwardly so as to be closer to the leverage bump of the clip than any other portion of that arm when that arm is bent back and in contact with the leverage bump.

19. A device comprising:

a clip that is not substantially triangular in shape when in an empty closed position, the clip having two ends; and an arm pivotally coupled to each end, each end having a hinge to which an arm is pivotally coupled, the arms being bowed toward each other when the arms are in an empty closed position and the device is viewed from a top profile, each arm including two hinge segments that are positioned at least partially within the hinge to which that arm is pivotally coupled, one of the hinge segments having a non-circular cross-sectional profile;

the device being sized to hold one or more of paper, cards and a wallet.

20. The device of claim 19, the clip having a leverage bump positioned such that one of the arms contacts the leverage bump when the clip is opened.

21. The device of claim 20, each arm having an elongated segment extending from the hinge segment of that arm; and, when the clip is opened, an elongated segment of a given arm contacts the clip before the given arm contacts the leverage bump.

22. The device of claim 21, the elongated segments of a given arm being separated by two slots and a middle segment.

23. The device of claim 22, each arm having a hinge element that includes one of the elongated segments and one of the hinge segments, the hinge element of a given arm being longer than the middle segment of the given arm.

24. The device of claim 22, an edge of the middle segment of each arm being positioned near a hinge of the clip.

25. The device of claim 20, each arm having a widest portion and the clip having a widest portion, the widest portions of the arms and the clip having substantially the same width.

26. The device of claim 25, the widest portion of each arm being positioned near the widest portion of the clip.

27. The device of claim 20, each arm including an indention.

28. The device of claim 27, the indention of one of the arms protruding outwardly so as to be closer to the leverage bump of the clip than any other portion of that arm when that arm is bent back and in contact with the leverage bump.

29. The device of claim 20, the clip having two leverage bumps, and each arm contacts a leverage bump when the clip is opened.

* * * * *